US010619982B2

(12) United States Patent
Romero

(10) Patent No.: US 10,619,982 B2
(45) Date of Patent: Apr. 14, 2020

(54) BROADHEAD WITH MULTIPLE DEPLOYABLE BLADES

(71) Applicant: Scott Romero, Newport, NC (US)

(72) Inventor: Scott Romero, Newport, NC (US)

(73) Assignee: R.R.A.D. LLC, Newport, NC (US)

( * ) Notice: Subject to any disclaimer, the term of this patent is extended or adjusted under 35 U.S.C. 154(b) by 0 days.

(21) Appl. No.: 16/106,812

(22) Filed: Aug. 21, 2018

(65) Prior Publication Data

US 2018/0356192 A1 Dec. 13, 2018

Related U.S. Application Data

(63) Continuation of application No. 15/611,923, filed on Jun. 2, 2017, now Pat. No. 10,082,373.

(60) Provisional application No. 62/352,177, filed on Jun. 20, 2016.

(51) Int. Cl.
*F42B 6/08* (2006.01)

(52) U.S. Cl.
CPC ..... *F42B 6/08* (2013.01)

(58) Field of Classification Search
CPC ..... F42B 6/04; F42B 6/08
USPC ..... 473/583, 582, 584
See application file for complete search history.

(56) References Cited

U.S. PATENT DOCUMENTS 4,616,835 A * 10/1986 Trotter ..... F42B 6/08 473/583
4,928,969 A 5/1990 Nagatori
4,940,246 A * 7/1990 Stagg ..... F42B 6/08 473/583
5,046,744 A * 9/1991 Eddy ..... F42B 6/08 473/583
5,078,407 A * 1/1992 Carlston ..... F42B 6/08 473/583
5,112,063 A * 5/1992 Puckett ..... F42B 6/08 473/583
5,172,916 A * 12/1992 Puckett ..... F42B 6/08 473/583
5,178,398 A * 1/1993 Eddy ..... F42B 6/08 473/583
5,322,297 A 6/1994 Smith
5,458,341 A * 10/1995 Forrest ..... F42B 6/08 473/583
5,562,237 A 10/1996 Saliaris
5,564,713 A 10/1996 Mizek
5,803,844 A * 9/1998 Anderson ..... F42B 6/08 473/583
5,820,498 A * 10/1998 Maleski ..... F42B 6/08 473/584

(Continued)

*Primary Examiner* — Alexander R Niconovich
(74) *Attorney, Agent, or Firm* — Eric B. Fugett; Mark A. Pitchford; Pitchford Fugett, PLLC

(57) ABSTRACT

A broadhead, comprising an elongated body defining a longitudinal axis and having a forward portion, a tip portion, and a rearward portion spaced from the forward portion. At least one forward blade is connected to the forward portion and configured for movement relative to the elongated body between a retracted position generally adjacent the elongated body to an extended position extending outwardly from the elongated body. And, at least one rearward blade connected to the rearward portion and configured for movement relative to the elongated body between a retracted position generally adjacent the elongated body to an extended position extending outwardly from the elongated body.

15 Claims, 17 Drawing Sheets

(56) References Cited

U.S. PATENT DOCUMENTS 5,857,930 A * 1/1999 Troncoso ..... F42B 6/08 473/583
5,879,252 A * 3/1999 Johnson ..... F42B 6/08 473/583
5,931,751 A 8/1999 Cooper
6,165,086 A 12/2000 Liechty, II
6,217,467 B1 * 4/2001 Maleski ..... F42B 6/08 473/583
6,258,000 B1 * 7/2001 Liechty, II ..... F42B 6/08 473/583
6,322,464 B1 * 11/2001 Sestak ..... F42B 6/08 473/583
6,398,676 B1 * 6/2002 Mizek ..... F42B 6/08 473/583
6,626,776 B2 * 9/2003 Barrie ..... F42B 6/08 473/583
6,830,523 B1 * 12/2004 Kuhn ..... F42B 6/08 473/583
D503,363 S 3/2005 Alsop
6,901,979 B1 6/2005 Herold
6,910,979 B2 * 6/2005 Barrie ..... F42B 6/08 473/583
D560,561 S 1/2008 Garcia
D564,947 S 3/2008 Garcia
7,338,397 B2 3/2008 Mizek
7,377,869 B2 * 5/2008 Wohlfeil ..... F42B 6/08 473/583
7,392,162 B1 6/2008 Srinivasan et al.
7,451,403 B1 11/2008 Srinivasan et al.
7,590,647 B2 9/2009 Srinivasan et al.
7,771,298 B2 * 8/2010 Pulkrabek ..... F42B 6/08 473/583
7,871,345 B2 1/2011 Cooper
7,905,802 B2 * 3/2011 Erhard ..... F42B 6/08 473/583
8,015,541 B1 9/2011 Srinivasan et al.
8,016,704 B1 * 9/2011 Vandewater ..... F42B 6/08 473/583
8,062,155 B2 * 11/2011 Butcher ..... F42B 6/08 473/578
8,100,788 B2 * 1/2012 Sanford ..... F42B 6/08 473/582
8,197,367 B2 6/2012 Pulkrabek et al.
8,272,979 B1 * 9/2012 Cooper ..... F42B 6/08 473/583
D669,955 S 10/2012 Minica
D669,956 S 10/2012 Minica
8,469,842 B2 * 6/2013 Mizek ..... F42B 6/08 473/583
8,469,843 B2 * 6/2013 Mizek ..... F42B 6/04 473/583
8,512,179 B2 8/2013 Pulkrabek et al.
8,545,349 B1 * 10/2013 Budris ..... F42B 6/08 473/582
8,758,176 B2 6/2014 Pedersen
8,758,177 B2 6/2014 Minica
D710,962 S 8/2014 Pedersen
D711,489 S 8/2014 Pedersen
8,905,874 B2 * 12/2014 Sullivan ..... F42B 12/34 473/583
8,911,311 B1 12/2014 Mizek
8,926,457 B2 * 1/2015 Treto ..... F42B 6/08 473/583
8,944,944 B2 2/2015 Pedersen et al.
D725,214 S 3/2015 Pedersen
8,986,141 B2 3/2015 Pedersen
D730,471 S 5/2015 Pedersen
9,028,347 B2 5/2015 Pedersen
9,046,330 B2 6/2015 Pedersen
9,046,331 B1 6/2015 Mallo
9,068,806 B2 6/2015 Pedersen
9,140,527 B2 9/2015 Pedersen et al.
9,151,580 B2 10/2015 Pedersen
9,157,710 B1 * 10/2015 Huntsman ..... F42B 6/08
9,163,895 B2 10/2015 Pedersen
9,163,898 B2 10/2015 Pedersen
9,170,078 B2 10/2015 Pedersen
D743,500 S 11/2015 Pedersen
D745,619 S 12/2015 Pedersen
9,228,813 B1 1/2016 Pedersen
9,243,874 B1 1/2016 Minica
9,341,449 B2 5/2016 Pedersen
9,372,056 B2 * 6/2016 Sullivan ..... F42B 6/08
9,404,720 B2 8/2016 Pedersen
9,404,722 B2 8/2016 Pedersen
9,410,775 B2 8/2016 Pedersen
9,410,778 B2 8/2016 Pedersen
9,423,219 B2 8/2016 Pedersen et al.
9,423,220 B2 8/2016 Pedersen
9,476,667 B2 10/2016 Pedersen
D774,615 S 12/2016 Pedersen
9,518,806 B2 12/2016 Pedersen
D776,782 S 1/2017 Pedersen
9,541,359 B2 1/2017 Pedersen
9,605,933 B2 3/2017 Pedersen
9,618,304 B2 4/2017 Pedersen
9,857,153 B1 * 1/2018 Redline ..... F42B 6/08
2005/0147773 A1 6/2005 Saliaris et al.
2008/0045363 A1 2/2008 Pulkrabek
2008/0261734 A1 * 10/2008 Cooper ..... F42B 6/08 473/584
2011/0137705 A1 6/2011 Srinivasan
2012/0040787 A1 * 2/2012 Ulmer ..... F42B 6/08 473/583
2014/0031152 A1 * 1/2014 Budris ..... F42B 6/08 473/583
2014/0128186 A1 5/2014 Treto
2014/0194234 A1 7/2014 Miles
2015/0020359 A1 1/2015 Pedersen
2015/0112664 A1 4/2015 Srinivasan
2015/0120738 A1 4/2015 Srinivasan
2016/0018182 A1 1/2016 Pedersen
2016/0076863 A1 3/2016 Pedersen
2016/0097617 A1 4/2016 Minica
2016/0188568 A1 6/2016 Srinivasan
2016/0258708 A1 9/2016 Syverson et al.
2016/0273892 A1 9/2016 Pedersen
2017/0184381 A1 * 6/2017 Loa ..... F42B 6/08

* cited by examiner

BROADHEAD WITH MULTIPLE DEPLOYABLE BLADES

CROSS-REFERENCES TO RELATED APPLICATIONS

This application is a continuation of U.S. patent application Ser. No. 15/611,923 entitled "Broadhead with Multiple Deployable Blades," now U.S. Pat. No. 10,082,373, which claims priority to U.S. Provisional Patent Application Ser. No. 62/352,177 entitled "Broadhead with Multiple Deployable Blades," filed on Jun. 20, 2016, all of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The invention relates generally to a broadhead arrowhead for hunting and other archery activities, and more particularly to a broadhead having multiple deployable blades fore and aft along its length.

Broadhead arrowheads, i.e., arrowheads with outwardly extending blades, are desirable for providing additional cutting action upon impact with a target, prey, or otherwise. Early broadheads included three blades and are known as tribolated arrowheads. A function of broadheads is to cause increased bleeding in the prey by delivering a broad cutting area leading to a quicker death of the prey. Broadheads can be of a fixed-blade variety or a deployable variety, wherein the blades are in a retracted position during flight, thereby impacting stability of the arrowhead during flight to a lesser degree, and move to an extended position upon contact with a target, such as prey.

While the foregoing broadhead designs are known, there exists a need for broadhead configurations that provide a relatively large cutting area to facilitate the formation in prey of a wound to prey that, for humane reasons, causes death quickly.

BRIEF SUMMARY

It is, therefore, the principal object of this invention to provide a broadhead with multiple deployable blades.

Generally, in one implementation, the present invention includes a broadhead, comprising an elongated body defining a longitudinal axis and having a forward portion, a tip portion, and a rearward portion spaced from the forward portion. At least one forward blade is connected to the forward portion and configured for movement relative to the elongated body between a retracted position generally adjacent the elongated body to an extended position extending outwardly from the elongated body. And, at least one rearward blade connected to the rearward portion and configured for movement relative to the elongated body between a retracted position generally adjacent the elongated body to an extended position extending outwardly from the elongated body portion.

Implementations described herein include the tip portion including at least a first tip blade and a second tip blade, and the first tip blade extending in a first plane, and the second tip blade extends in a second plane at an angle with respect to the first plane, and wherein the second plane is generally perpendicular to the first plane.

An implementation described herein includes the first tip blade forming the extreme end of the broadhead, and the second tip blade is recessed from the first tip blade along the longitudinal axis.

In one implementation a forward blade is configured to generally pivot relative to the elongated body as the forward blade moves between the retracted position and the extended position.

In certain implementations, the rearward blade is configured to generally pivot relative to the elongated body as the rearward blade moves between the retracted position and the extended position.

In another implementation, the forward blade includes a first forward blade and a second forward blade, each being configured to move in opposite directions with respect to one another during the movement between the retracted position and the extended position.

Implementations described herein include the tip portion including at least a first tip blade and a second tip blade, and the first tip blade extending in a first plane, and the second tip blade extends in a second plane, and wherein the second plane is generally perpendicular to the first plane, a first forward blade configured to move in a third plane, a second forward blade configured to move in a fourth plane (the third and fourth planes being generally parallel to one another), and first and second rearward blades, each configured to move in a fifth plane.

Implementations described herein include the tip portion including at least a first tip blade and a second tip blade, and the first tip blade extending in a first plane, and the second tip blade extends in a second plane angled with respect to the first plane, and wherein the second plane is generally perpendicular to the first plane, a first forward blade configured to move in a third plane, a second forward blade configured to move in a fourth plane (the third and fourth planes being generally parallel to one another), and first and second rearward blades, each configured to move in a fifth plane, and wherein the first plane is at an acute angle with respect to the third and fourth plane, and the fifth plane is substantially perpendicular to the third and fourth planes.

In other implementations, the forward blade moves in a counterclockwise direction relative to the tip portion and the longitudinal axis during movement between the retracted position and the extended position, and the rearward blade moves in a clockwise direction relative to the tip portion and the longitudinal axis during movement between the retracted position and the extended position.

Further implementations include the forward blade having a forward wing, or lever. extending generally perpendicular to the longitudinal axis upon the at least one forward blade being in the retracted position, and the forward lever being configured upon force being applied thereto to cause the forward blade to pivot outwardly towards the extended position, and the rearward blade having a rearward wing, or lever, extending generally perpendicular to the longitudinal axis upon the at least one forward blade being in the retracted position, and the rearward lever being configured upon force being applied thereto to cause the at least one rearward blade to pivot outwardly towards the extended position.

Additional implementations include a first forward blade and a second forward blade each being configured to pivot in opposite directions with respect to one another during the movement between the retracted position and the extended position and a post to which each of the first forward blade and the second forward blade are linked and about which each of the first forward blade and the second forward blade are configured to pivot.

Still further implementations include a first rearward blade and a second rearward blade each being configured to pivot in opposite directions with respect to one another during the movement between the retracted position and the extended position and a first pivot to which the first rearward blade is linked and about which the first rearward blade is configured to pivot; a second pivot to which the second rearward blade is linked and about which the second rearward blade is configured to pivot; and the first pivot and the second pivot being non-colinear and/or non-coaxial with respect to each other.

In another implementation, the tip portion has a generally parabolic cross-sectional profile generally coaxial with the longitudinal axis, and the elongated body is tapered outwardly from the forward portion towards the rearward portion along the longitudinal axis.

In certain implementations, at least one band configured to restrain the at least one forward blade and the at least one rearward blade in the retracted position, and the band is configured to be severed by the at least one forward blade upon a predetermined force being applied to the forward lever, wherein the at least one forward blade is consequently substantially unrestrained by the band and is permitted to pivots outwardly towards the extended position of the at least one forward blade. The elongated body defines a channel for receiving the band, and the band is constructed of an elastic material.

In another implementation, a method is described herein for using blades of a broadhead in relation to a target, comprising: providing an elongated body having a forward portion having a tip blade, at least one forward blade, at least one forward lever attached to the forward blade, at least one rearward blade spaced from the rearward blade, and at least one rearward lever attached to the rearward blade, each of the forward blade and the rearward blade being independently movable between a respective retracted position generally adjacent the elongated body to an extended position extending outwardly from the elongated body portion; propelling the broadhead towards the target; impacting the target with the tip blade, after the impacting of the target with the tip blade, impacting the forward lever with the target with sufficient force to cause the forward blade to pivot forwardly and outwardly towards the extended position of the forward blade; and after the impacting of the target with the forward lever blade, impacting the rearward lever with the target with sufficient force to cause the rearward blade to pivot rearwardly and outwardly towards the extended position of the rearward blade.

In some implementations, the impacting of the rearward lever occurs after the forward blade begins to move towards the extended position, and the at least one forward blade includes a first forward blade and a second forward blade, each being configured to move generally away from one another during the movement between the retracted position and the extended position.

In another implementation, the impact of the broadhead with the target causes an opening in the target consisting of a single slit. In a further implementation, the elongated body exits the target, and upon exiting the target, the broadhead leaves an exit opening generally consisting of a first elongated slit and a second elongated slit generally perpendicularly bisecting the first elongated slit.

BRIEF DESCRIPTION OF THE DRAWINGS

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DETAILED DESCRIPTION

Figure 1:
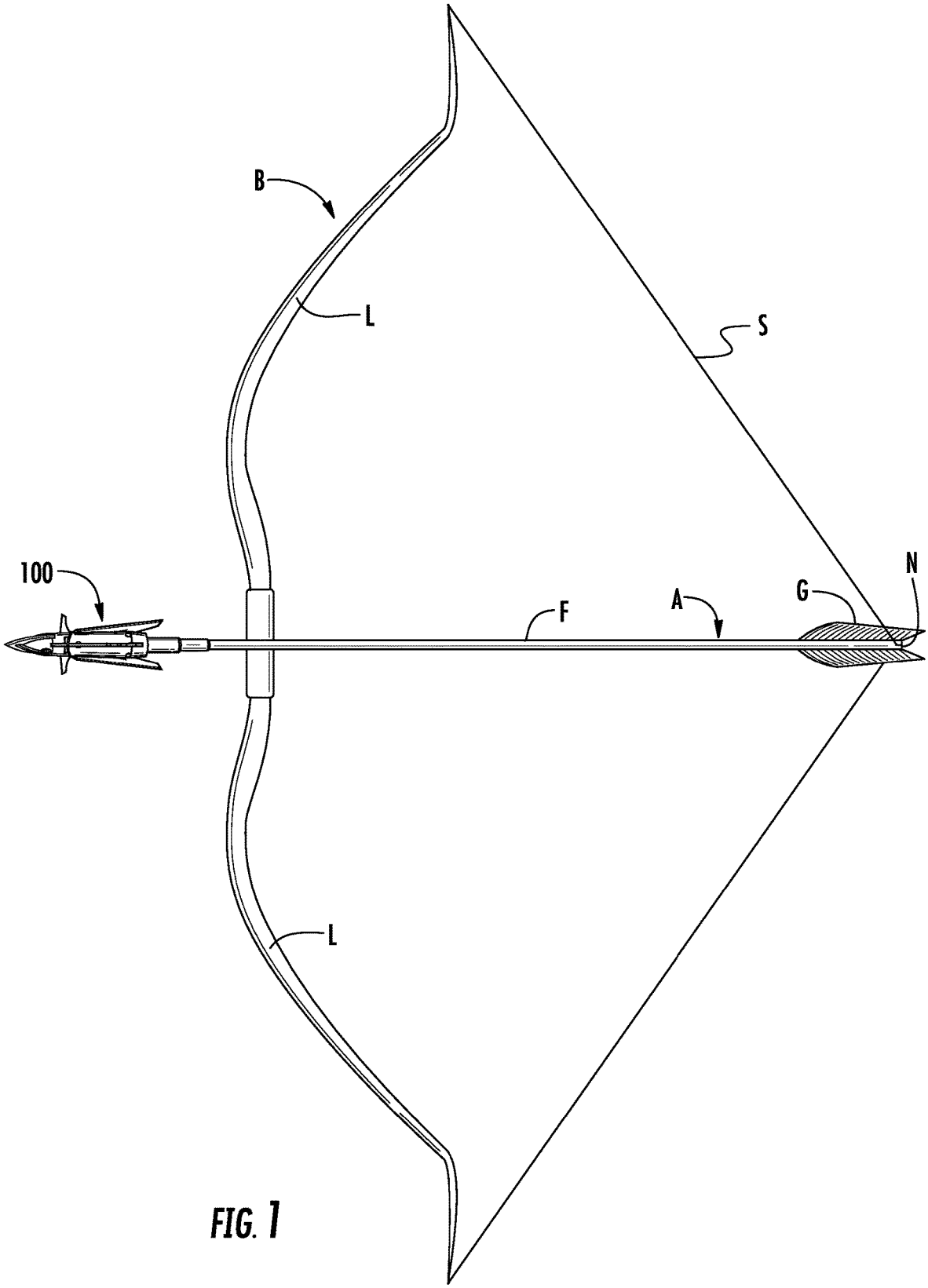
FIG. 1 is a schematic view of one implementation of a broadhead with multiple deployable blades constructed in accordance with the present disclosure showing the broadhead attached to an arrow.

The accompanying drawings and the description which follows set forth this invention in several of its preferred embodiments. However, it is contemplated that persons generally familiar with broadhead arrows will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, one implementation of a broadhead with multiple blades as described herein is indicated generally in the figures by reference character 100.

Turning to FIG. 1, one implementation of a broadhead 100 with multiple deployable blades is shown. Broadhead 100 is attached to the forward end of an arrow A, which includes a shaft F, fletching G, and a nock N, which receives a string S, and the string being attached to limbs L of bow B. As shown in FIG. 1, arrow A is in a position ready for release with string S and bow B being under tension. Arrow A is thus ready to be launched downrange towards a target, which could include a fixed target, moving target, practice target, or prey (which could include an animal such as deer, elk, etc.).

Figure 2:
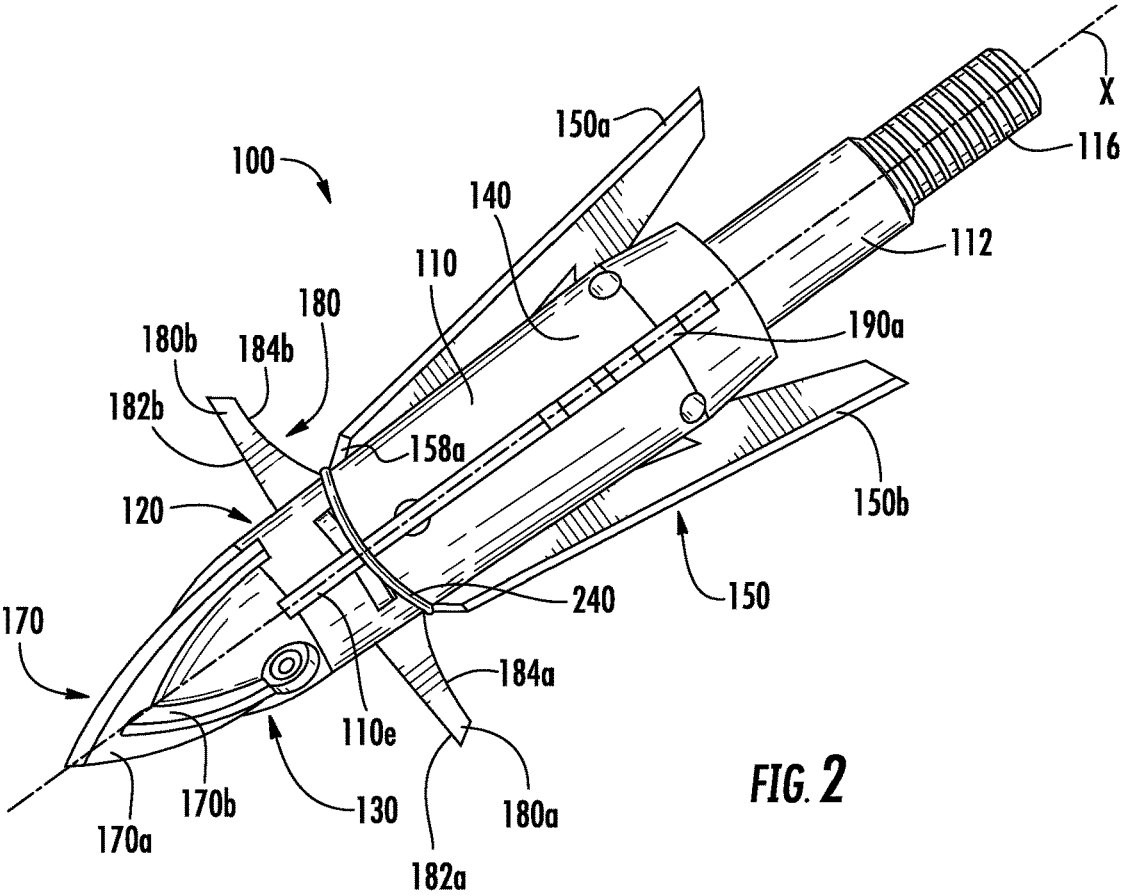
FIG. 2 is a perspective view of the broadhead of FIG. 1, showing the forward blades in a retracted position.
Figure 3:
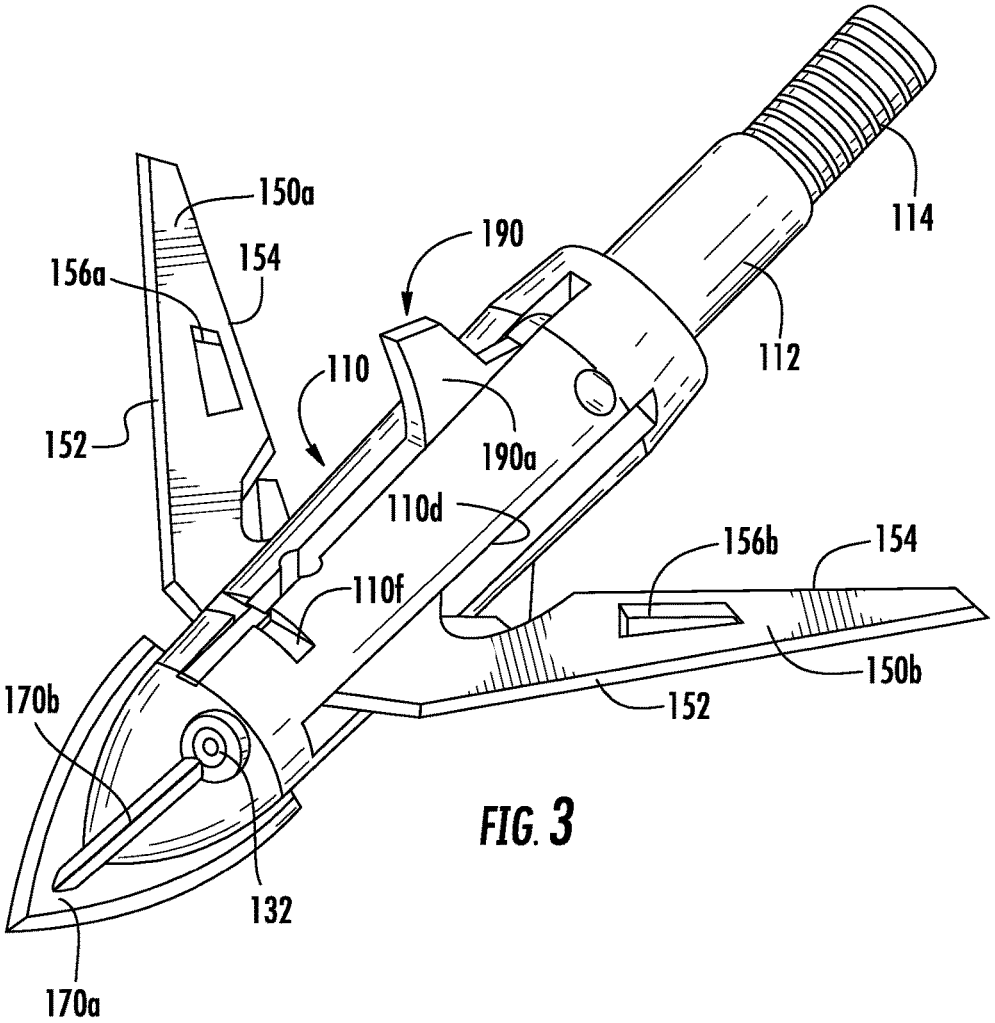
FIG. 3 is a perspective view of the broadhead of FIG. 1, showing the forward blades in an extended, or deployed, position.
Figure 4:
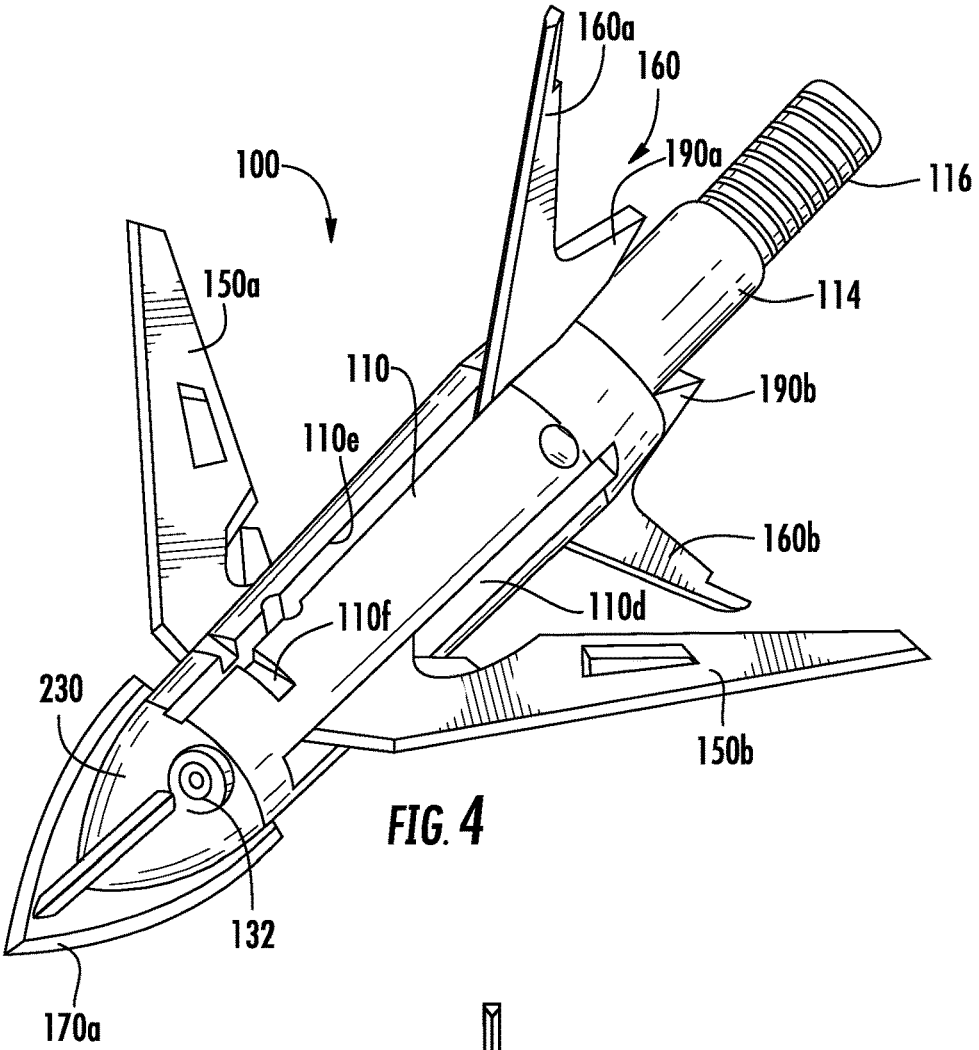
FIG. 4 is a perspective view of the broadhead of FIG. 2, showing the forward blades in an extended, or deployed, position and the rearward blades in an extended, or deployed, position.
Figure 4A:
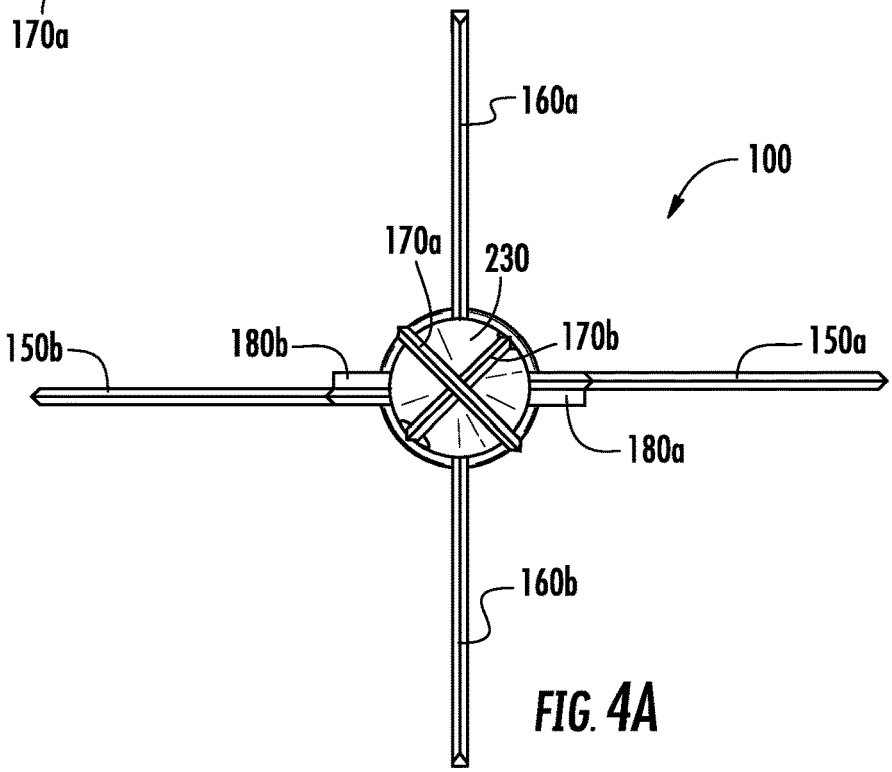
FIG. 4A is a front elevational view of the broadhead shown in FIG. 4.

As discussed above, broadhead 100 includes an elongated frame, or body, generally 110, which defines a longitudinal axis x and includes a forward portion, generally 120, a tip portion, generally 130, and a rearward portion, generally 140, spaced from the forward portion 120. At least one forward blade, generally 150, is connected to the forward portion 120 of frame, frame portion, body, or body portion, 110 for pivotal movement between a retracted position, as shown in FIG. 2, generally adjacent frame 110 and received in slots 110*d* and cavity 110*g* of body portion 110, to an extended, or deployed, position, as shown in FIG. 3, extending outwardly from the frame portion 110. In the implementation shown in the figures, forward blade 150 includes two blades, namely, forward blade 150*a* and 150*b*. Also, at least one rearward blade, generally 160, is connected to the rearward portion 140 of frame 110 and is configured for movement relative to frame 110 between a retracted position, as shown in FIG. 2, wherein rearward blades 160 are adjacent frame 110 and are received in slots 110*e* and cavity 110*g* of frame 110, to an extended, or deployed, position extending outwardly from frame 110, as shown in FIG. 4. The at least one rearward blade 160 includes, in one implementation, rearward blades 160*a* and 160*b*.

As used herein, "pivots," "pivot" or "pivoting" means to substantially rotational movement of an item relative to another item and also to combined rotational and rectilinear movements of an item relative to another item.

Figure 2A:
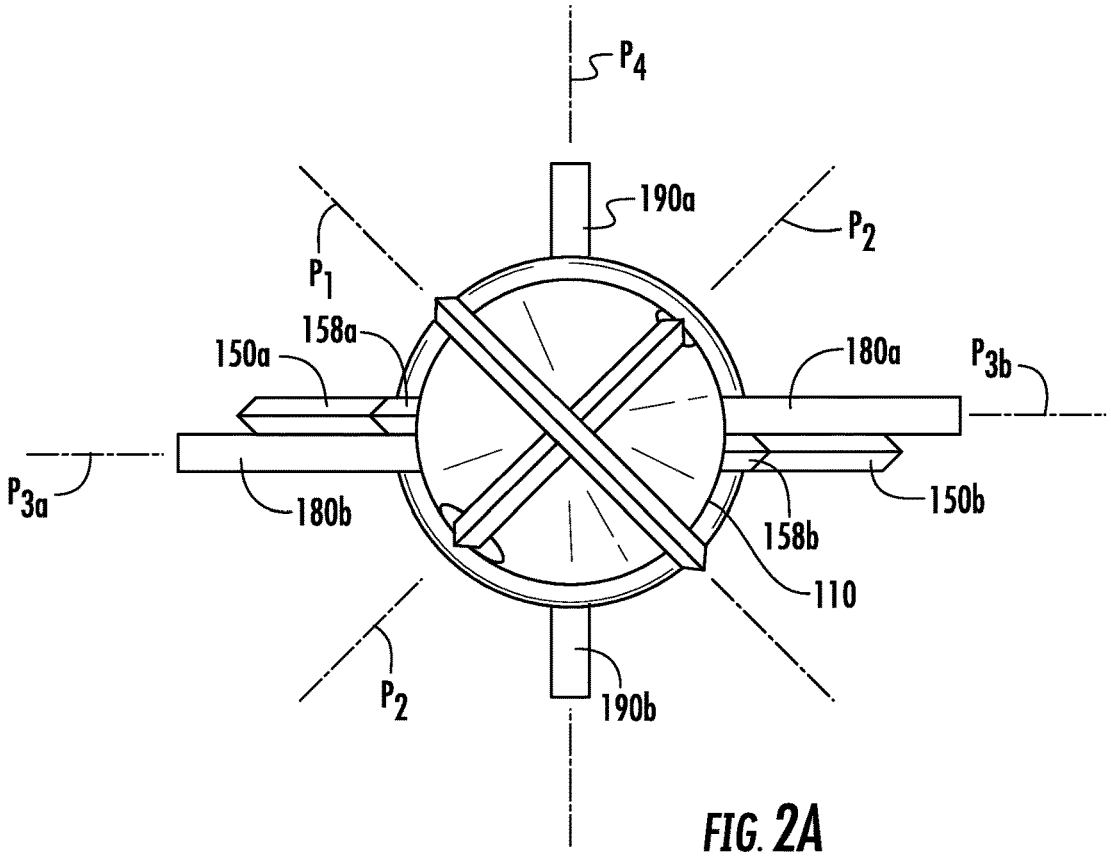
FIG. 2A is a front elevational view of the broadhead of FIG. 2.

The tip portion 130 of frame 110 includes a first tip blade 170*a*, having cutting edges 172*a*, and a second tip blade 170*b*, having cutting edges 172*b*. In one implementation, tip blade 170*a* extends in a first plane $P_1$ as shown in FIG. 2A, and tip blade 170*b* extends in a second plane $P_2$, and wherein the second plane $P_2$ is generally perpendicular to the first plane $P_1$. Tip blade 170*a* forms the extreme end of broadhead 100 and tip blade 170*b* is recessed rearwardly from tip blade 170*a* along longitudinal axis x. In an implementation shown in the figures, forward blades 150*a*, 150*b* are configured to move or generally pivot relative to frame 110 between the retracted position and the extended position. Similarly, rearward blades 160*a*, 160*b* are configured to pivot relative to frame 110 as the rearward blades move between the retracted position and the extended position.

As the forward blades 150*a*, 150*b* pivot from the retracted position to the extended position, they move in opposite directions from one another, as can be seen FIGS. 2 and 3. More specifically, forward blade 150*a* pivots counterclockwise with respect to tip portion 130, as it moves between the retracted and deployed position, whereas forward blade 150*b* moves in a clockwise direction between the retracted and deployed positions. Rearward blades 160*a*, 160*b* also move in opposite directions with respect to one another as they move from the extended position to the deployed position, namely, rearward blade 160*a* moves in a clockwise direction with respect to tip portion 130 as it moves from the retracted to the deployed position, and rearward blade 160*b* moves in the counterclockwise direction between the retracted and deployed positions.

As the forward blades 150*a*, 150*b* move from the retracted to the deployed positions, they move through generally parallel planes $P_{3a}$ and $P_{3b}$, given forward blades 150*a* and 150*b* are stacked with respect to one another, in a scissor-like manner. More specifically, forward blade 150*a* moves through plane $P_{3a}$ between the retracted and deployed positions, and forward blade 150*b* moves through plane $P_{3b}$ between the retracted and deployed positions. Rearward blades 160*a*, 160*b* move generally in the same plane $P_4$ with respect to one another as rearward blades 160*a*, 160*b* move between the retracted and deployed positions.

Figure 3A:
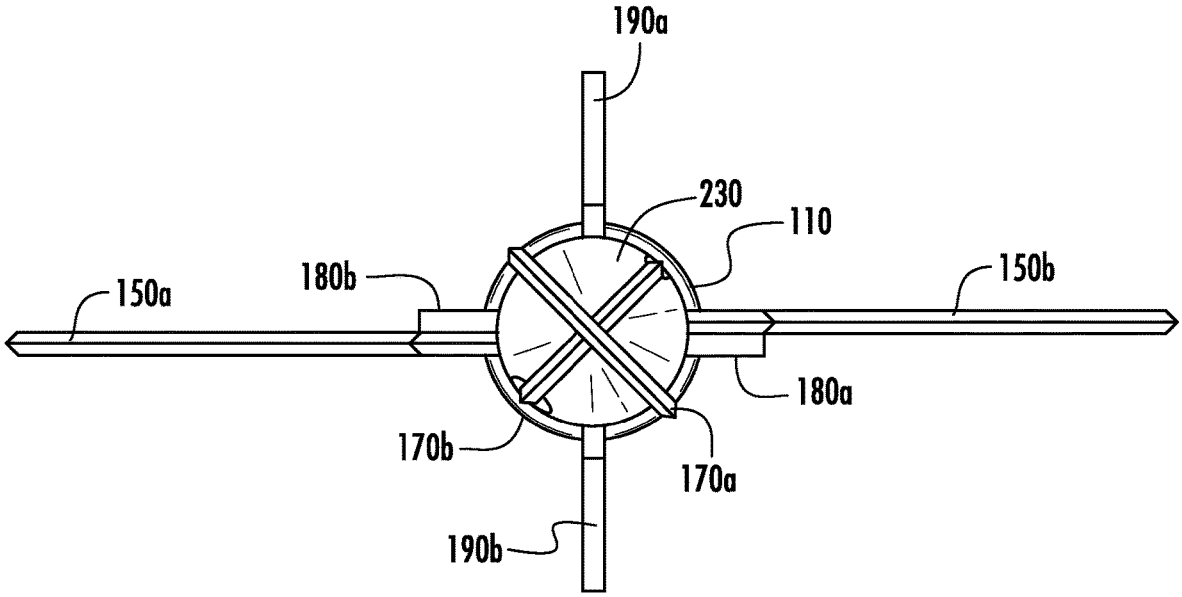
FIG. 3A is a front elevational view of the broadhead of FIG. 3.

In certain implementations, forward blades 150*a*, 150*b* include a forward wing, or lever, generally 180. More specifically, forward blade 150*a* includes lever 180*a*, and forward blade 150*b* includes lever 180*b*. Levers 180*a*, 180*b* extend outwardly generally transverse and/or perpendicular to longitudinal axis x, as shown in FIG. 2, when forward blades 150*a*, 150*b* are in the retracted position. Forward lever 180*a* includes a leading edge 182*a* and a trailing edge 184*a* spaced rearwardly from leading edge 182*a* with respect to tip portion 130. Similarly, forward lever 180*b* includes a leading edge 182*b* and a trailing edge 184*b*. In one implementation, each forward lever 180*a*, 180*b* is configured its leading edge is generally blunt and such that upon the respective leading edge contacting an object, such as target T when broadhead 100 and arrow A are in flight, the force of impact against target T on leading edges 182*a*, 182*b* cause levers 180*a*, 180*b* to pivot rearwardly with respect to tip portion 130. Because levers 180*a*, 180*b* are rigidly attached to forward blades 150*a*, 150*b*, respectively, the rearward pivoting of levers 180*a*, 180*b* in a scissors-like manner forces forward blades 150*a*, 150*b*, respectively, from the retracted position in slots 110*d* towards the deployed position. Once in the deployed position, forward blades 150*a*, 150*b* extend radially outwardly from frame 110, as shown in FIG. 3A, and present a cutting face extending significantly beyond the respective cutting faces provided by tip blades 170*a* and 170*b*.

For example, as shown in FIGS. 9-14, as broadhead 100 initially contacts a target T, such as a deer or other animal, tip blades 170*a*, 170*b* provide the initial cutting action into the outer surface of the target, which in the case of an animal, could be its hair, fur, and/or skin. Thus, the forward-most tip blade, namely tip blade 170*a*, would likely make the initial piercing of the outer surface of the target with the second tip blade 170*b* making the second contact, since cutting blade 170*b* is recessed rearwardly from tip blade 170*a*.

Figure 10:
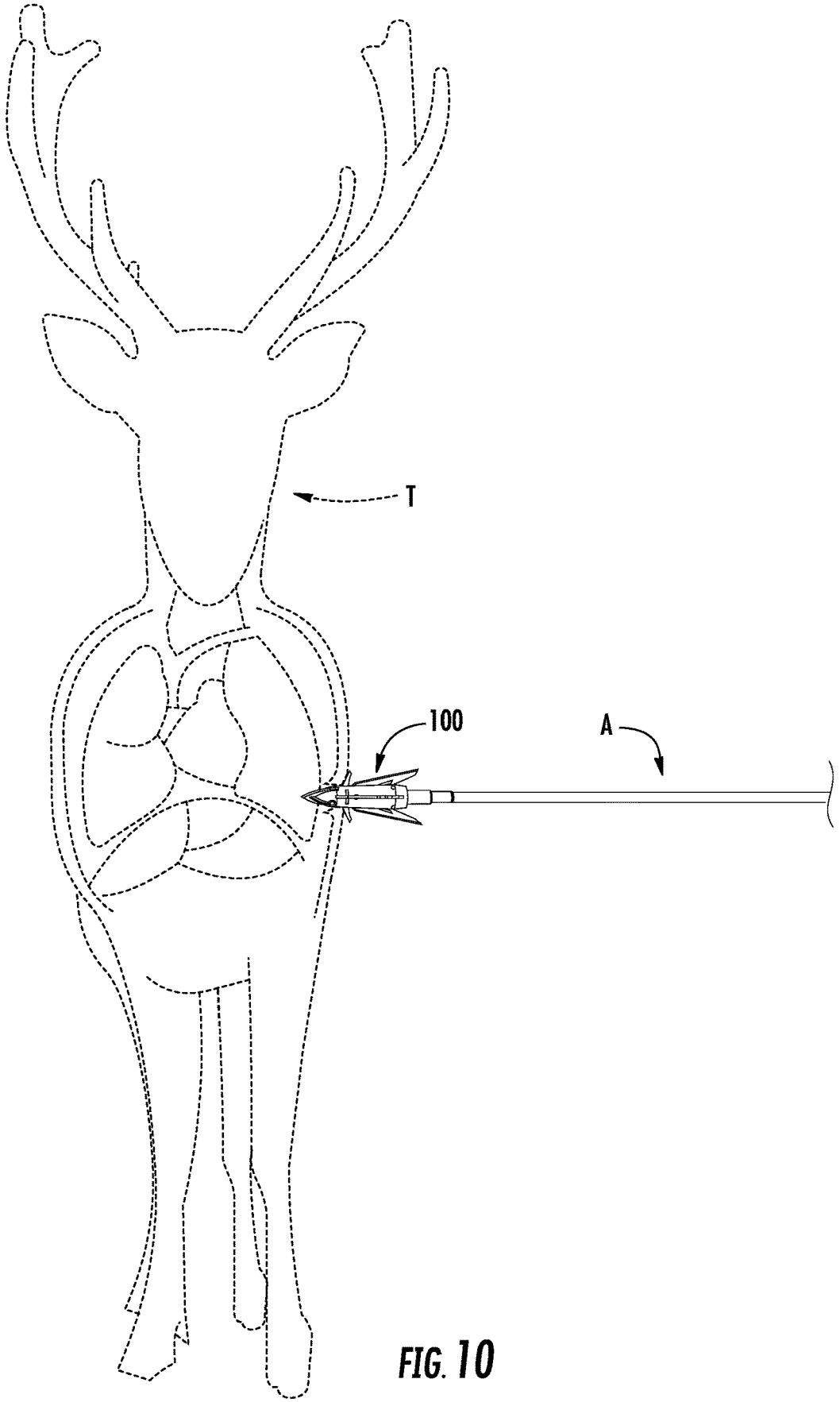
FIG. 10 is a schematic view of the broadhead of FIG. 9, wherein at least one lever attached to a forward blade contacts the outer surface of a target, such as an animal.

As shown in FIG. 10, tip portion 130 has penetrated the target and has progressed beyond the surface of the animal's skin. Note that because tip blades 170*a* and 170*b* are oriented in perpendicular planes, namely, plane $P_1$ and $P_2$, they provide cutting action along those planes. Once tip portion 130 has reached sufficient depth in target T, the respective leading edges 182*a*, 182*b* of forward levers 180*a*, 180*b* contact the surface of target T along yet other planes, i.e., planes $P_{3a}$ and $P_{3b}$, which are circumferentially offset from planes $P_1$ and $P_2$. Thus, levers 180*a* and 180*b* should make initial contact directly on the surface of the animal, rather than in a hole or other passage already cut by tip blades 170*a*, 170*b*.

Figure 11:
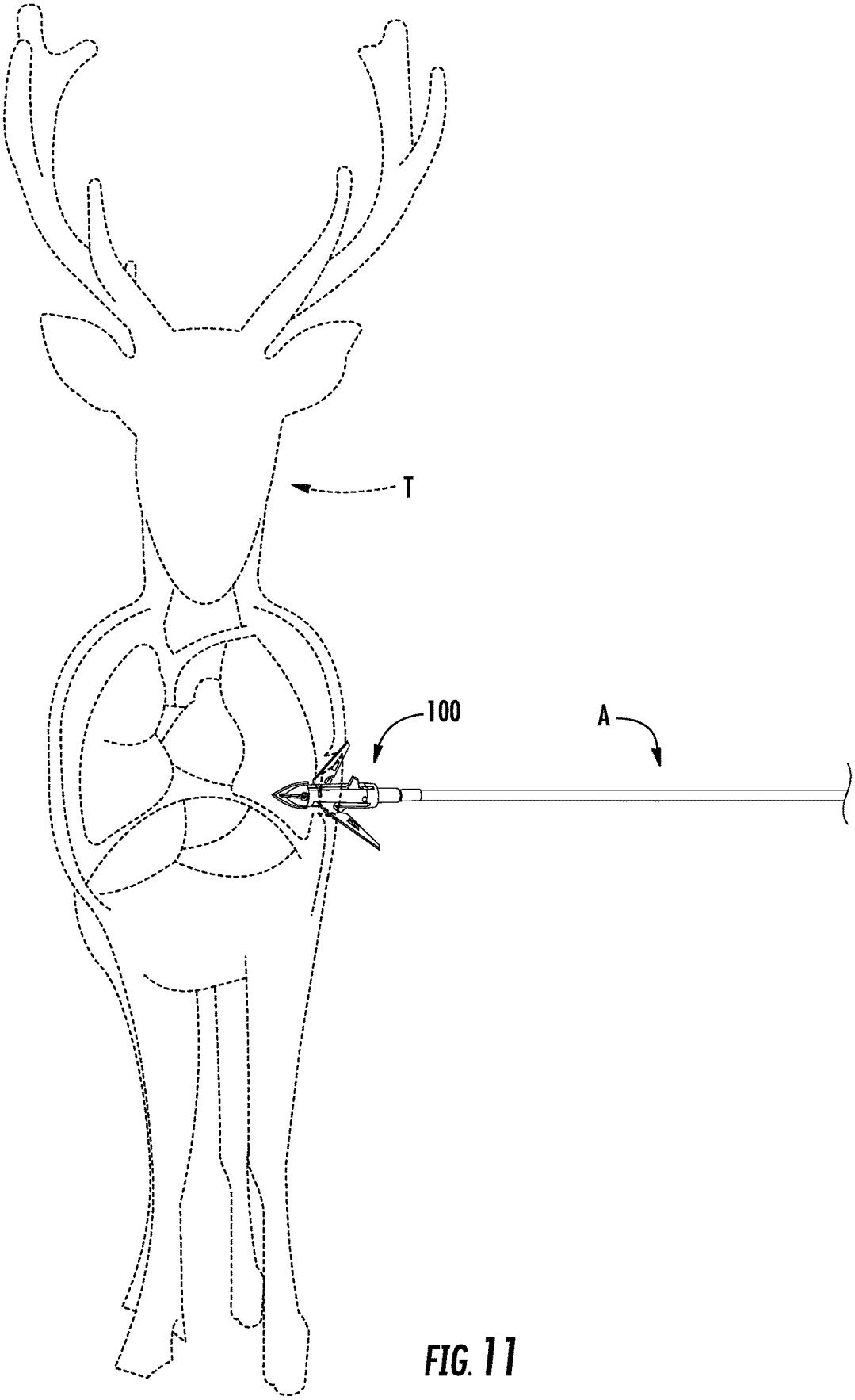
FIG. 11 is a schematic view of the broadhead of FIG. 9, wherein the forward blades are shown in or moving towards the extended position as the broadhead penetrates the target.

The force of impact of forward levers 180*a*, 180*b* against the surface of target T, due to the rigid connection of levers 180*a*, 180*b* with blades 150*a*, 150*b*, respectively, forces not only levers 180*a*, 180*b* to pivot rearwardly towards slots 110*d*, but also cause forward blades 150*a*, 150*b* to pivot outwardly from the retracted position towards the deployed position. The deployment of forward blades 150*a*, 150*b* is shown in FIG. 11. It should be noted that as forward levers 180*a*, 180*b* move rearwardly, they cause retaining band, or band, 240 to be severed or snap and to thus fall away from broadhead 100. This is due to the scissors-like action at the interface between the forward levers 180*a*, 180*b* with the ledges 158*b*, 158*a*, respectively, of forward blades, 150*b*, 150*a*, respectively. Band 240 keeps forward blades 150*a*, 150*b* and rearward blades 160*a*, 160*b* in place within slots 110*d* and 110*e* respectively while broadhead 100 is in flight and is otherwise prior to penetrating the target, namely, prior to forward levers 180*a*, 180*b* impacting the target and thereby either alone or in combination with the pivoting of forward blades 150*a*, 150*b* being severed.

Figure 12:
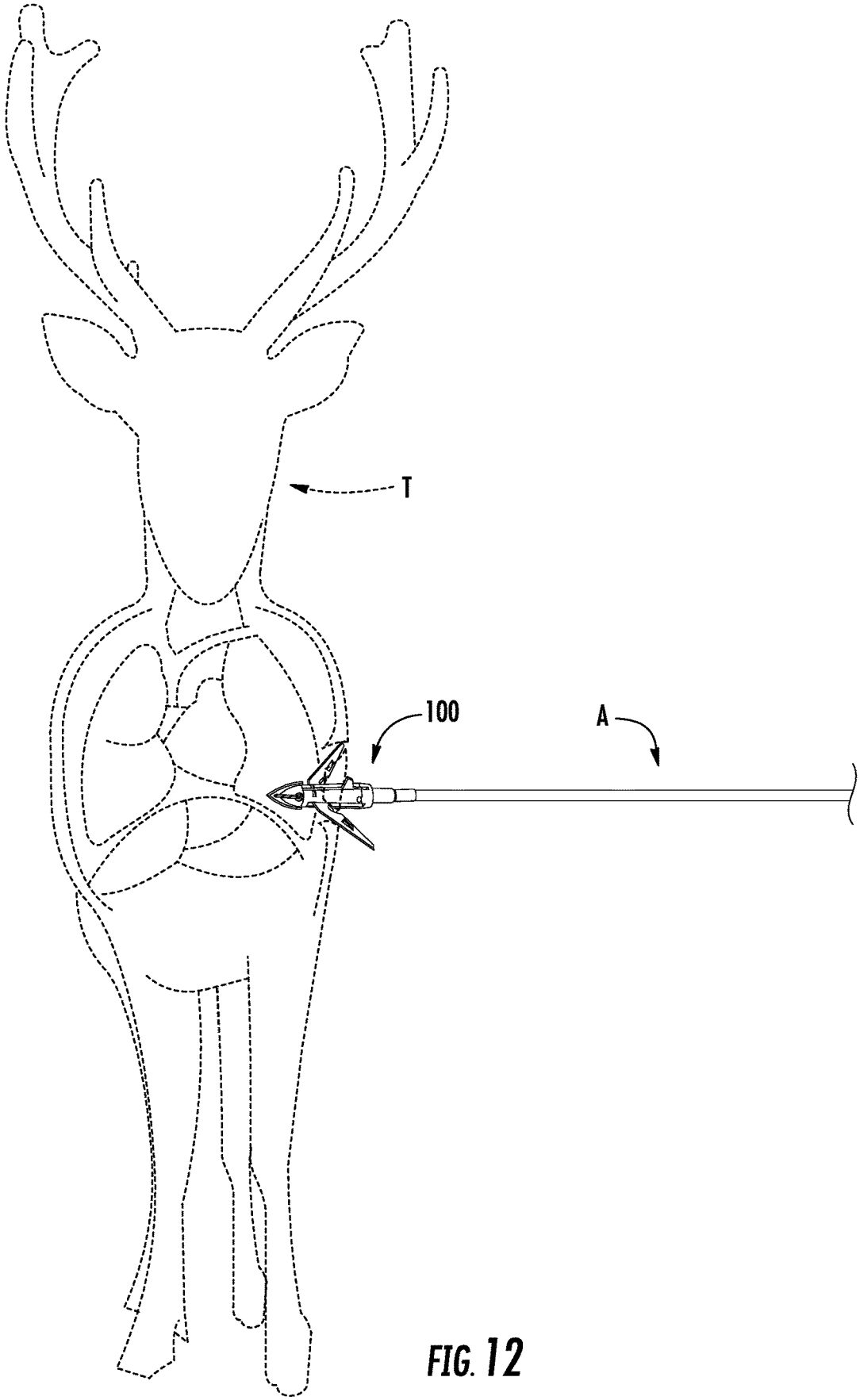
FIG. 12 is a schematic view of the broadhead of FIG. 9, wherein at least one lever of a rearward blade contacts the flesh of the target.
Figure 13:
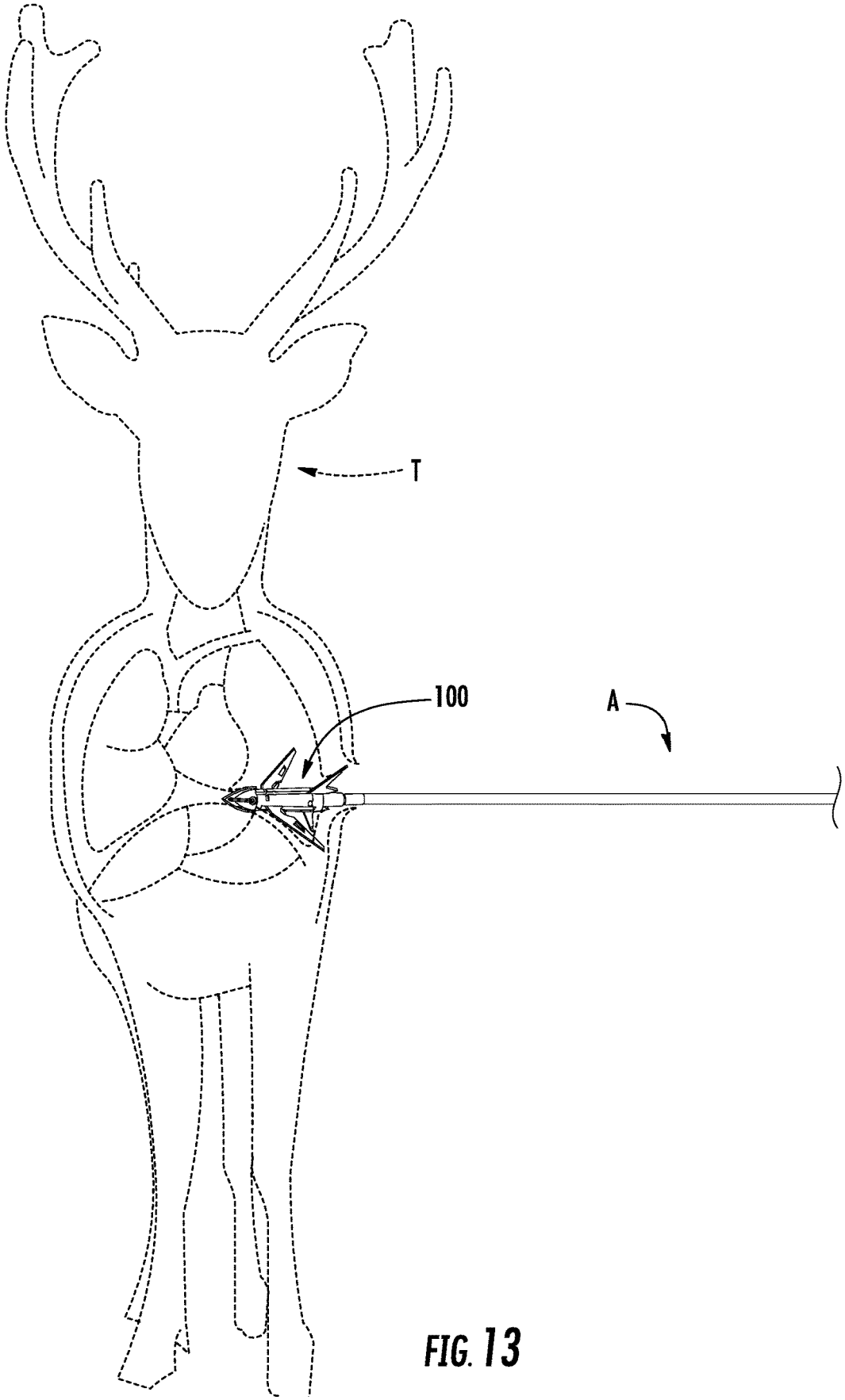
FIG. 13 is a schematic of the broadhead of FIG. 9, wherein the rearward blades are shown in or moving towards the extended position as the broadhead progresses through the body of the target.

FIGS. 11 and 12 show that as arrow A continues its forward motion, and as forward blades 150*a*, 150*b* are deploying or have deployed, the leading edges 192*a*, 192*b* (which are generally blunt in one implementation) of levers 190*a*, 190*b*, respectively, contact the surface of target T in a still further plane, namely $P_4$, than previously cut by tip blades 170*a*, 170*b* and forward blades 150*a*, 150*b*. As the leading edges 192*a*, 192*b* of rearward levers 190*a*, 190*b* receive force from the outer surface, skin and/or flesh of target T, rearward levers 190*a*, 190*b* are forced to pivot rearwardly, and because rearward levers 190*a*, 190*b* are rigidly connected to rearward blades 160*a*, 160*b*, respectively, rearward blades 160*a*, 160*b* move from their retracted position in slots 110*e* of frame 110 towards their deployed position, wherein the cutting surfaces provided on each of the leading edges 162*a*, 162*b* of rearward blades 160*a*, 160*b*, respectively, begin a cutting action through the flesh and internal portions of the target T, as illustrated in FIG. 13, similar to the manner in which the cutting surfaces 172*a*, 172*b* of tip blades 170*a* and 170*b*, respectively, and of the leading edges 152*a* and 152*b* of forward blades 150*a*, 150*b*, respectively, also provide a cutting action within target T. And also rearward blades 160*a*, 160*b* being deployed and progressing through the internal portions of the target. For rearward blades 160*a*, 160*b* to move from their retracted position in slots 110*e* of frame 110 towards their deployed position, the force on rearward levers 190*a*, 190*b* must be greater than any forces keeping the rearward blades 160*a*, 160*b* in their retracted position. Forces keeping the rearward blades 160*a*, 160*b* in their retracted position can, in some embodiments, include a band. In some embodiments, the rearward blades 160*a*, 160*b* will not move toward their deployed position or be fully deployed until inside a soft cavity region of the target T, e.g., the chest cavity or intestinal cavity of an animal. Better penetration of the broadhead into the target results because less resistance (e.g., friction) is encountered by the broadhead when the rearward blades deploy inside a soft cavity of the target T, instead of, for example, at the surface or skin of the target T.

Figure 14:
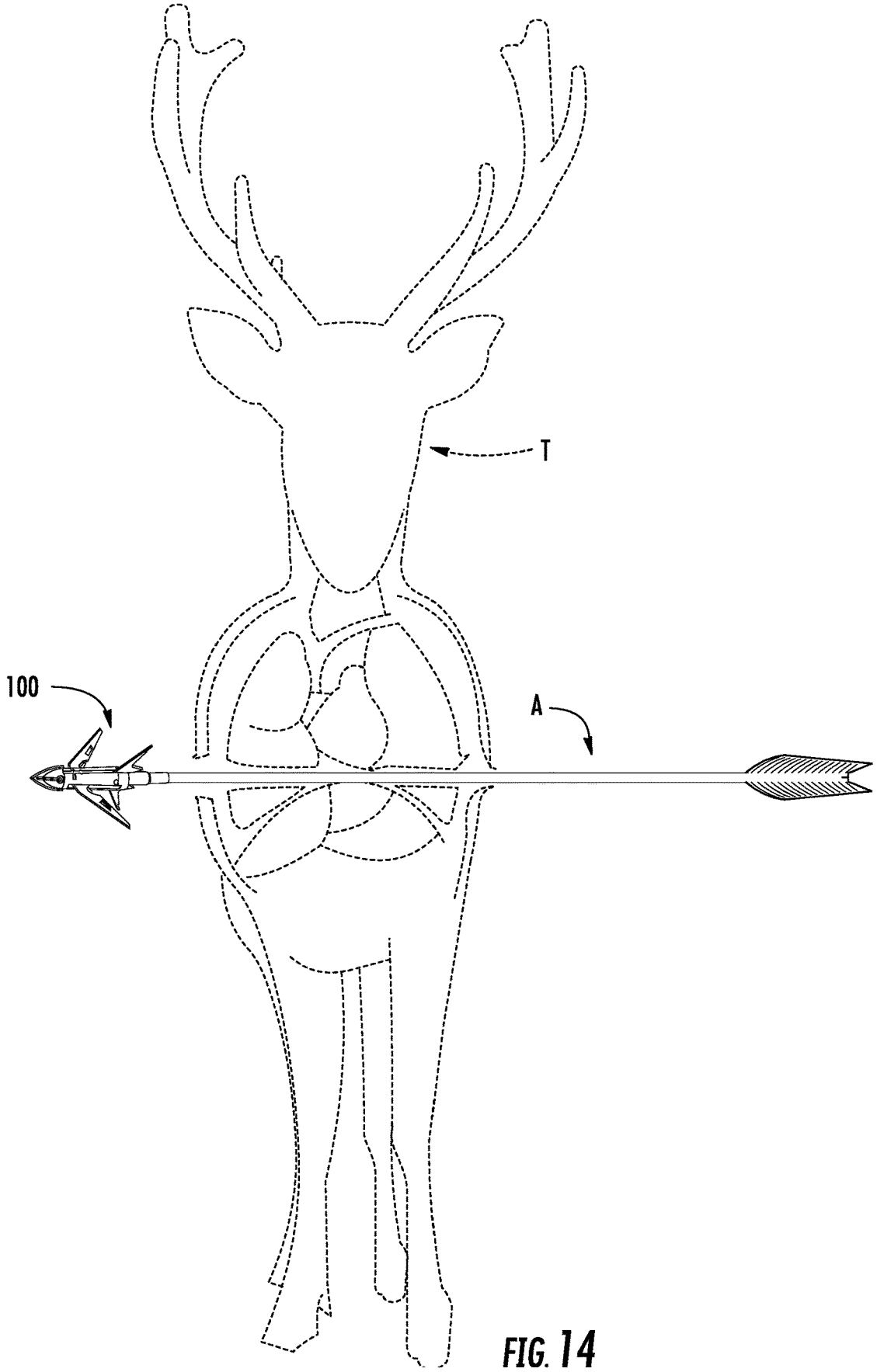
FIG. 14 is a schematic view of the broadhead of FIG. 9, where in the broadhead is shown exiting the target and wherein the forward blades and rearward blades are generally fully deployed to the extended position.

FIG. 14 illustrates broadhead 110 having fully penetrated and exited target T with the shaft F of arrow A passing through the passage created by broadhead 100 within target T.

Figure 15:
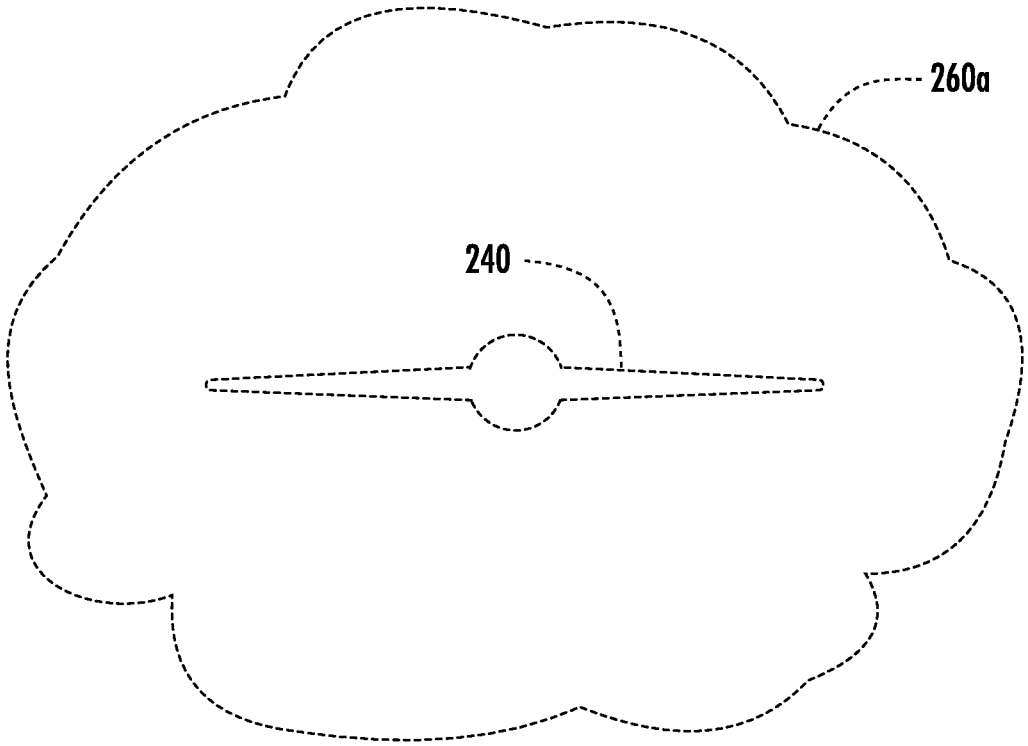
FIG. 15 is a schematic representation of an entry opening, or wound, of a target, such as an animal, made by one implementation of a broadhead with multiple deployable blades as described herein.

FIG. 15 illustrates a target T opening or wound profile which may be expected after arrow A has passed through the surface, or skin, $T_1$ and flesh and internal organs $T_2$ of target T discussed above in FIGS. 9-14. This entrance wound is generally a single slit 270 within the surface 260*a* of a target T. The elongated slit includes a central, generally circular portion, formed primarily by the cutting edge of tip blades 170*a* and 170*b*, and radially extending elongated portions formed primarily by forward blades 150*a* and 150*b*.

Figure 16:
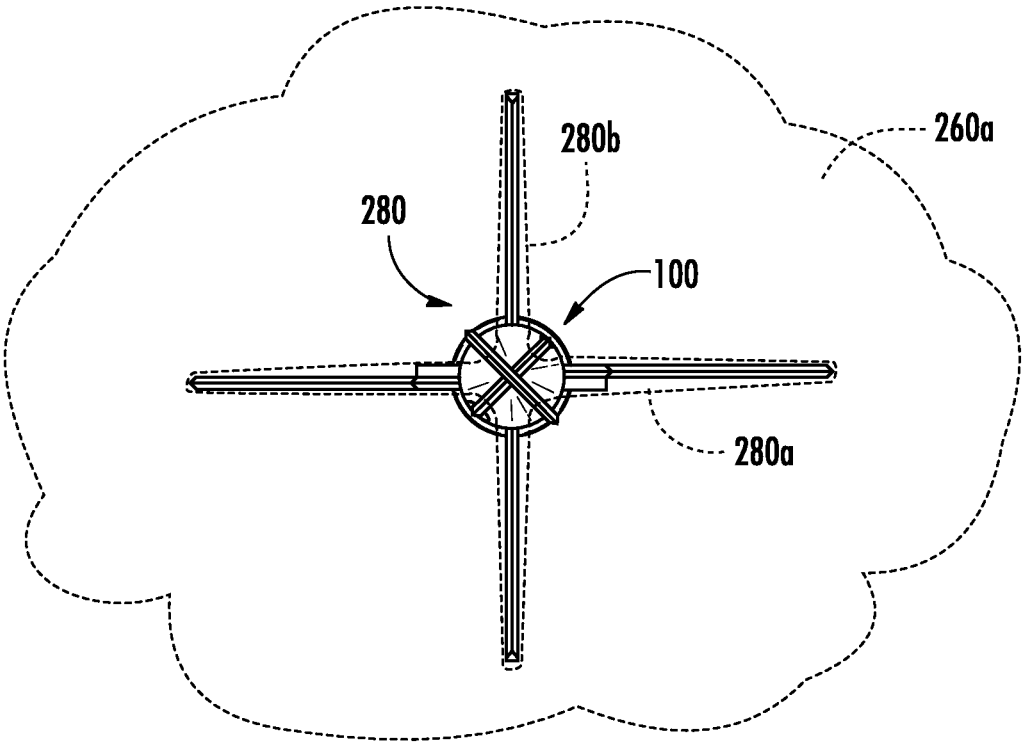
FIG. 16 is a schematic view of one implementation of a broadhead with multiple deployable blades as it exits a target, such as an animal.
Figure 17:
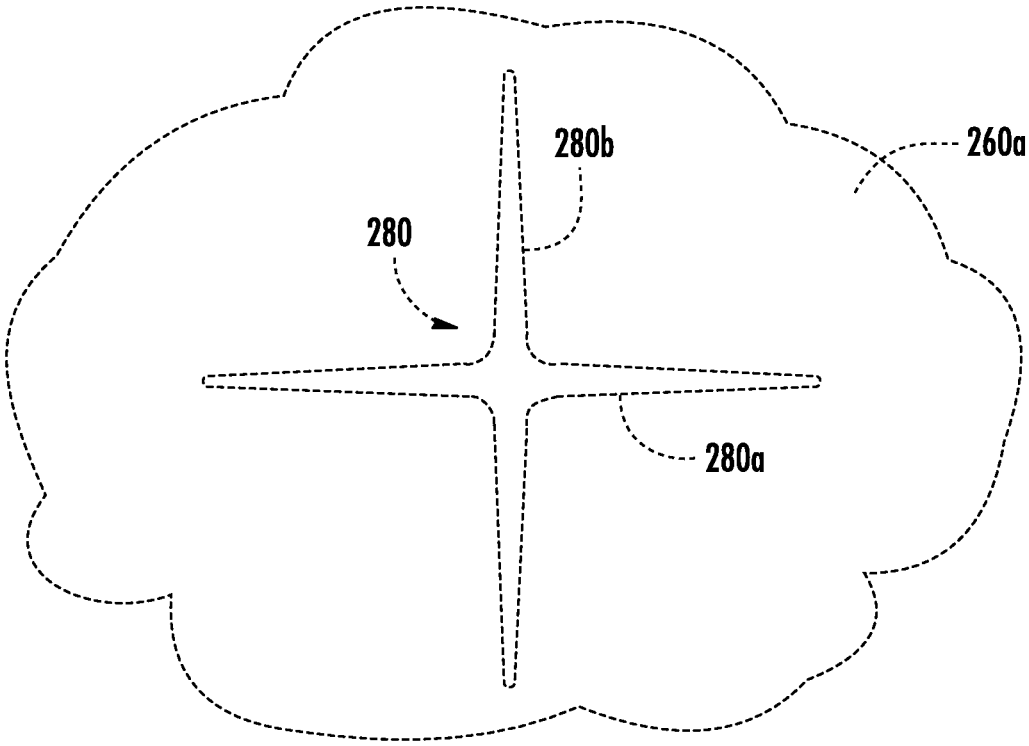
FIG. 17 is a schematic view of an exit opening, or wound, of a target, such as an animal, resulting from penetration by one implementation of a broadhead with multiple deployable blades as described herein.

FIG. 16 illustrates the exit wound 280 from the target animal, and more specifically, the surface of the flesh 260*b* of the animal. This exit wound 280 includes a first slit 280*a* and a second slit 280*b* generally bisecting and perpendicular to the first slit 280*a*. Slits 280*a*, 280*b* are each elongated, with slit 280*a* being formed primarily by forward blades 150*a*, 150*b*, and slit portion 280*b* being formed primarily by rearward blades 160*a*, 160*b*. FIG. 16 illustrates the broadhead 100 as it is exiting wound 280, whereas FIG. 17 illustrates the profile of wound 280 after broadhead 100 and arrow A have passed all the way through wound 280.

FIG. 13 illustrates forward blades 150*a*, 150*b* being deployed and also rearward blades 160*a*, 160*b* being deployed and progressing through the internal portions of the target.

Figures 5, 6:
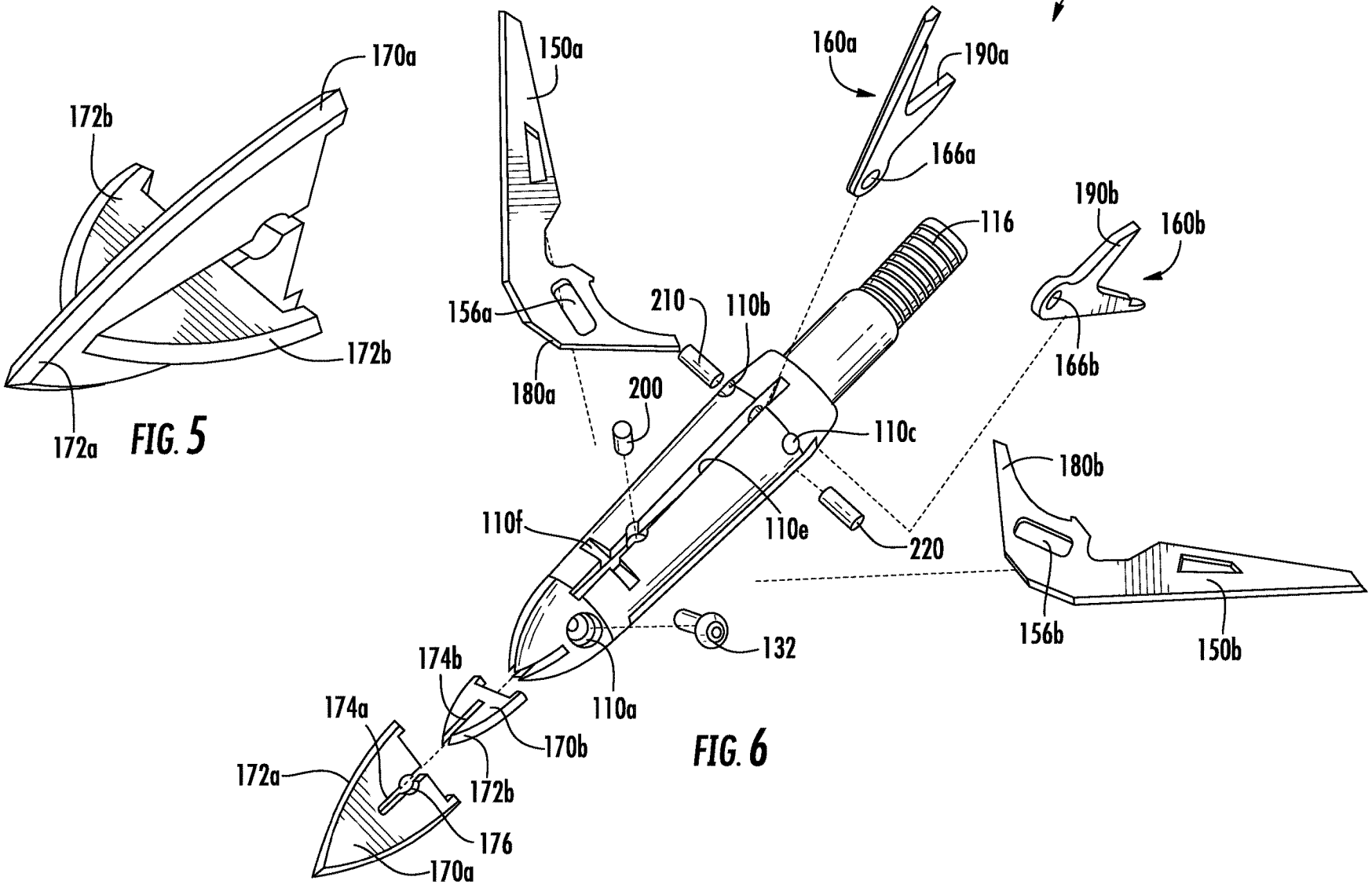
FIG. 5 is a partial perspective view of one implementation of tip blades for a broadhead with multiple deployable blades described herein.
FIG. 6 is an exploded view of one implementation of a broadhead with multiple deployment blades described herein.
Figure 7:
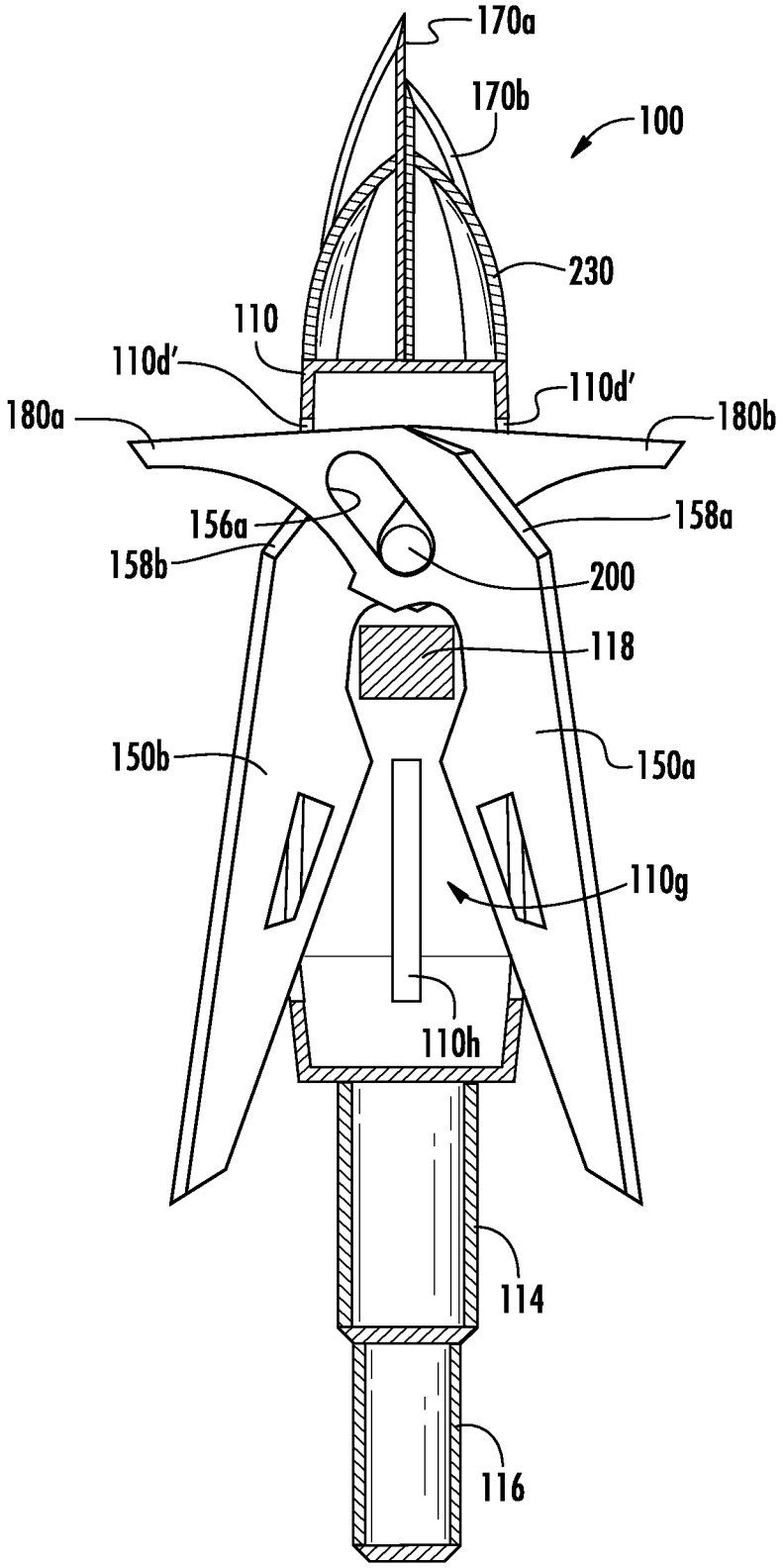
FIG. 7 is a schematic view of one implementation of a broadhead with multiple deployable blades described herein, having forward blades shown in a retracted position.
Figure 7A:
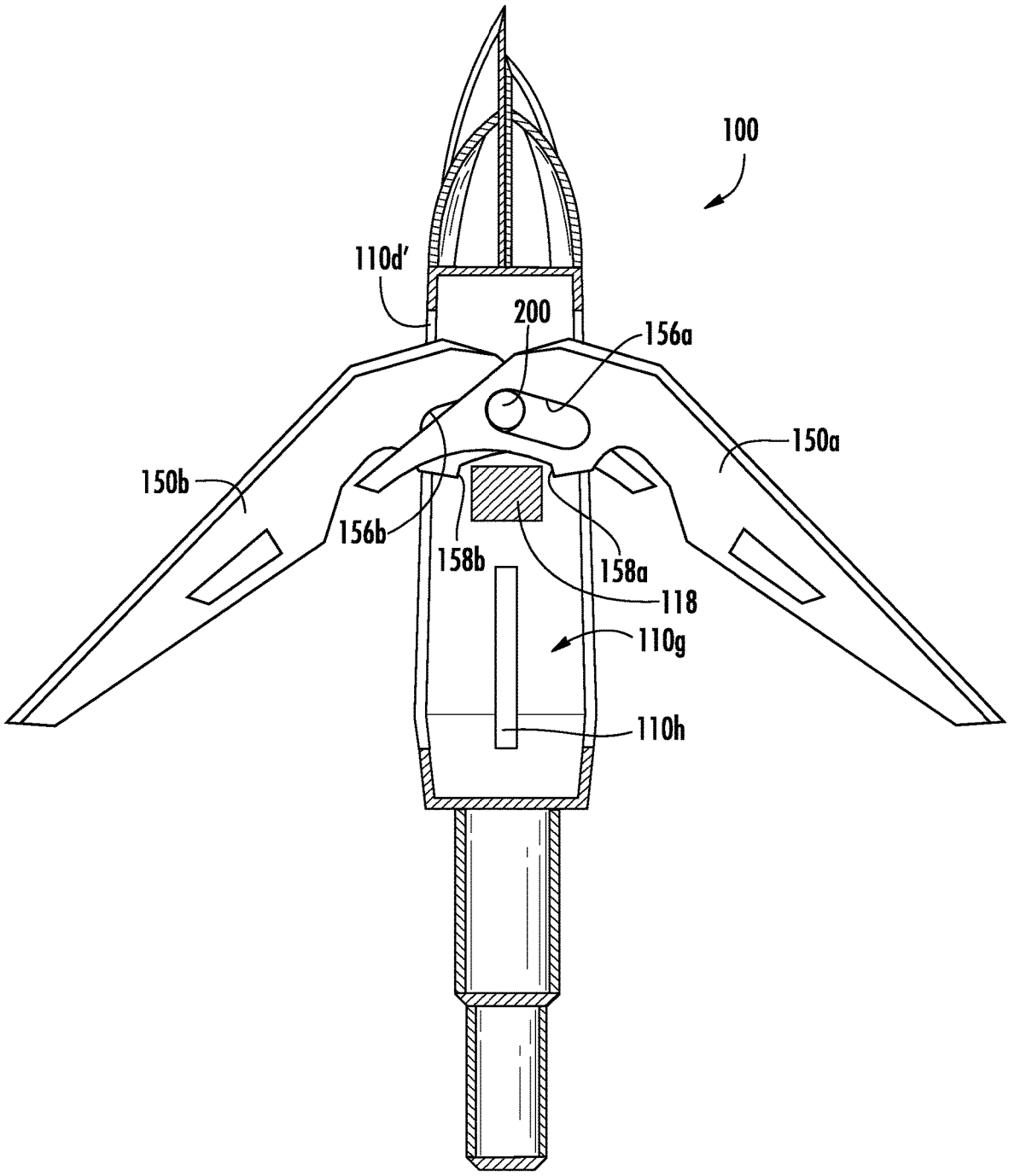
FIG. 7A is a schematic view of the broadhead of FIG. 7, showing the forward blades in an extended position.

As shown in FIGS. 6, 7, and 7A, forward blades 150*a*, 150*b* are connected to broadhead 110 via engagement of a post, or pivot pin, 200 with elongated slots 156*a* and 156*b* in forward blades 150*a*, 150*b*, respectively. In one implementation, pivot pin 200 is positioned on longitudinal axis x and could be a roll pin or screw, if desired. These elongated slots allow blades 150*a* and 150*b* to experience rotational and some rectilinear motion as the forward blades 150*a*, 150*b* move between the retracted and extended positions. This allows for a greater degree of freedom of movement of forward blades 150*a* and 150*b* with respect to pivot pin 200 and frame 110. More particularly, it allows for clearance of the extreme ends of levers 180*a* and 180*b* as they move with forward blades 150*a* and 150*b* from the retracted to the extended position generally within cavity 110*g* of frame 110 and thereby the extreme ends of levers 180*a*, 180*b* to clear the extreme upper end 110*d*' of slots 110*d* as shown in FIGS. 7 and 7A.

Accordingly, as used herein, the term "pivot" includes such motion as permitted by forward blades 150*a* and 150*b* about pivot pin 200 given the interaction of pin 200 with elongated slots 156*a* and 156*b*. A block 118 (which in one implementation is positioned on longitudinal axis x) is also provided within cavity 110*f* which acts as a blade lock for generally locking forward blades 150*a*, 150*b*, respectively, in the extended position as shown in FIG. 7A. In such arrangement, blade stops 158*a* and 158*b* of forward blades 150*a* and 150*b* are engagable with block 118 to deter rearward movement of blades 150*a*, 150*b* beyond a predetermined amount back towards the retracted position once such blades are in the deployed position as broadhead 100 is moving through the target. Block 118 can be either separately formed and attached to body 110 by a fastener, or integrally formed as part of elongated body 110. It is to be noted that in FIG. 7A, the pivot pin 200 is at or near the extreme end of slots 156*a*, 156*b*, respectively, whereas when forward blades 150*a*, 150*b* are in the retracted position, pivot pin 200 is at or near the other extreme end of slots 156*a*, 156*a*, respectively.

Figure 8:
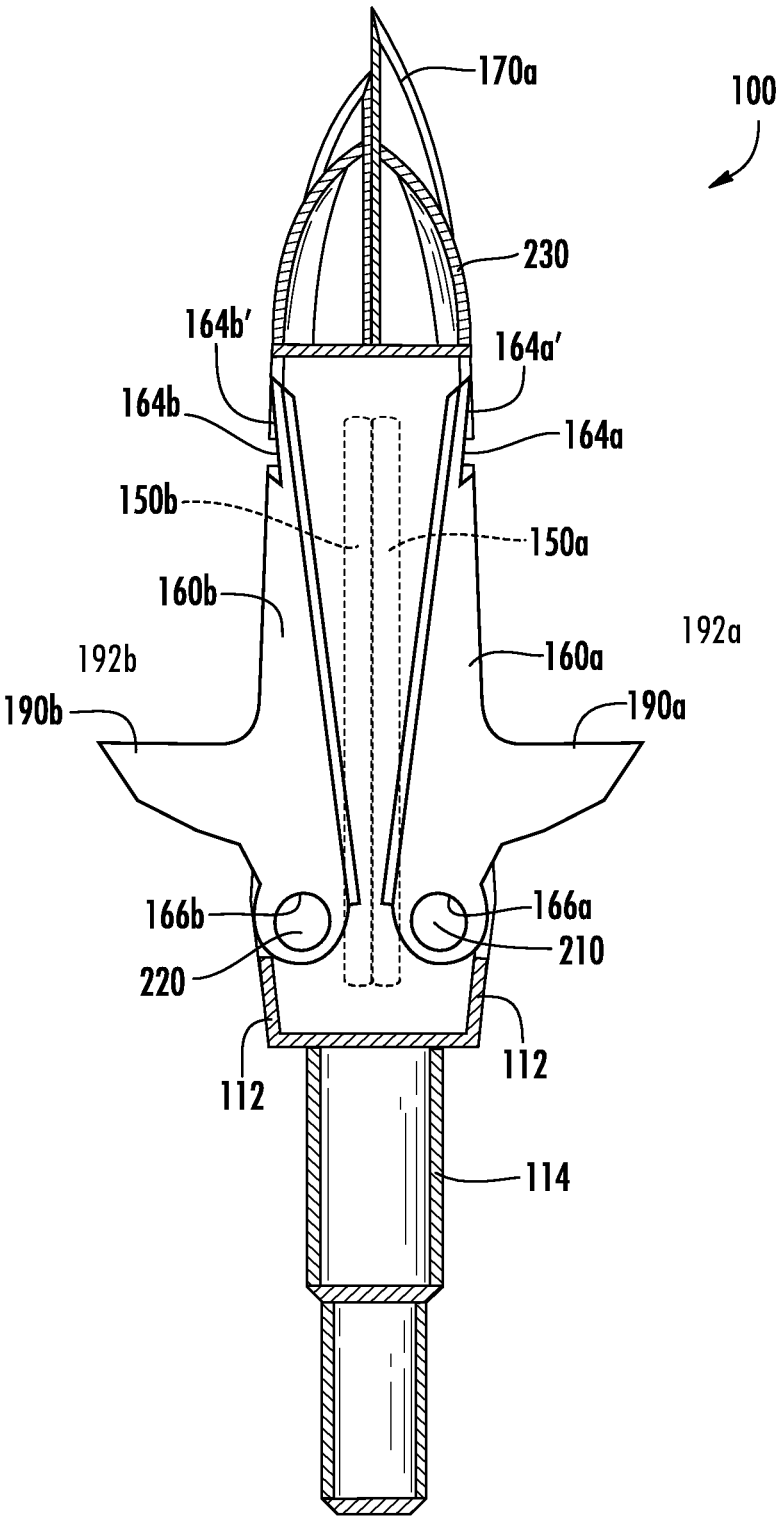
FIG. 8 is a schematic view of one implementation of a broadhead with multiple deployable blades described herein, having rearward blades shown in a retracted position.
Figure 8A:
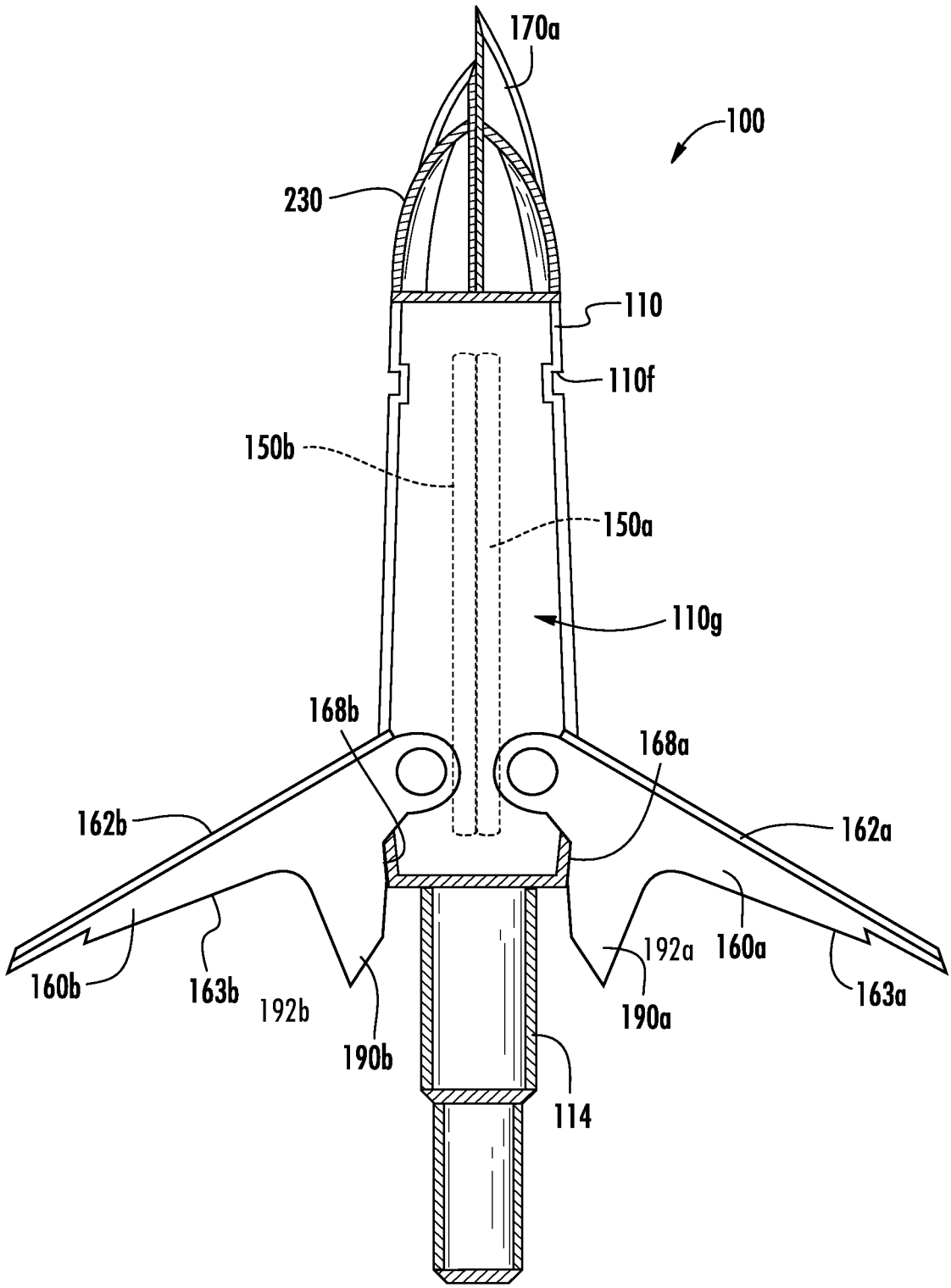
FIG. 8A is a schematic view of the broadhead of FIG. 8, showing the rearward blades in an extended position.
Figure 9:
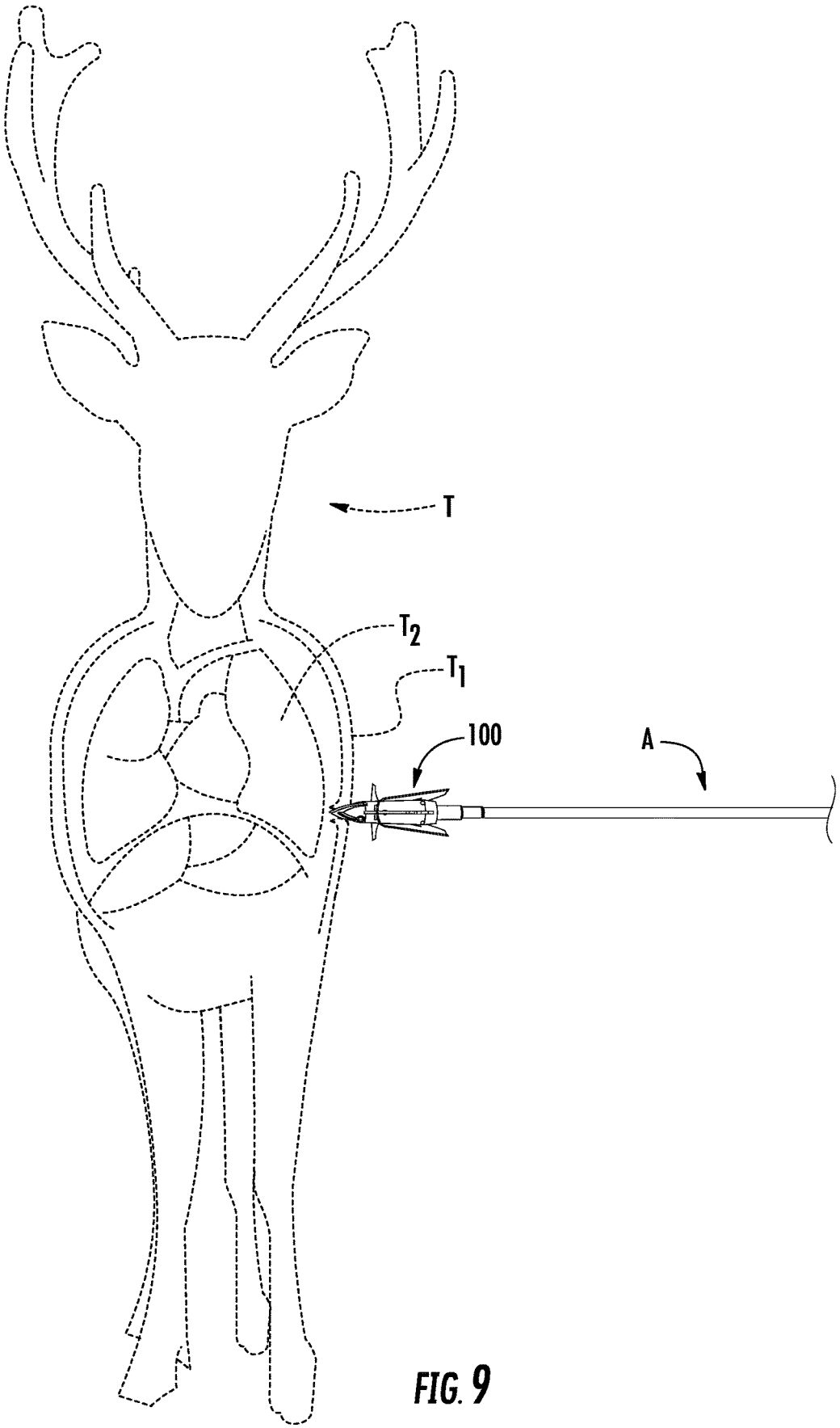
FIG. 9 is a schematic view of a broadhead with multiple deployable blades as described herein, wherein at least one tip blade is contacting a target, or prey, such as a deer or other animal, and wherein the forward blades and rearward blades of the broadhead are shown in the retracted position.

Turning to FIGS. 8 and 8A, the operation of one implementation of rear blades 160*a*, 160*b* is further explained. In FIG. 8A, rearward blades 160*a* and 160*b* are in the retracted position, and each such blade includes a hole 166*a* and 166*b*, respectively, which receives a pin or post, such as pivot pin 210 and 220, respectively, which in some embodiments, could be a roll pin, screw or the like. Rearward blades 160*a*, 160*b* pivot between the retracted and extended positions through engagement of pins 210, 220 with holes 166*a* and 166*b*, respectively. Pivot pins 210 and 220 extend generally parallel to one another but are not colinear, i.e., they are laterally offset from one another and spaced transversely outwardly from longitudinal axis x.

As shown in FIG. 8A, wherein blades 160*a* and 160*b* are in the deployed configuration, the cutting edges, or surfaces, of leading edges 162*a* and 162*b* are exposed for cutting through the target T. Blade stops 168*a* and 168*b* of rearward blades 160*a*, 160*b*, respectively, contact an inwardly tapered skirt portion 112 (which in one implementation is generally coaxial with longitudinal axis x) of frame 110 to limit movement of blades 160*a*, 160*b* beyond a desired deployment position. For example, in one embodiment, beyond 30 degrees with respect to the longitudinal axis x. In other words, the interaction between blade stops 168*a* and 168*b* with skirt 112 serves to prevent rearward blades 160*a* and 160*b* from pivoting too far rearwardly, which could result in diminished cutting ability of broadhead 100 as broadhead 100 moves through target T.

Extending rearwardly from skirt 112 is a shaft portion 114 centered about longitudinal axis x, and adjacent to shaft portion 114 is a threaded portion 116 which is threaded into the open threaded end of shaft F of arrow A when attaching broadhead 100 to arrow A.

Tip portion 230 includes a generally parabolic cross sectional profile, as shown in FIGS. 7, 7A, 8, and 8A, which facilitates aerodynamics and penetration of broadhead 100 into a target. Frame portion 110 extends rearwardly from tip portion 230 and tapers outwardly therefrom until reaching the juncture of skirt 112, i.e., the portion of frame 110 between tip portion 130 and skirt 112 is substantially frustoconically shaped. A wall 110*h* is provided within cavity 110*g* and provides structural support for frame 110 as such wall runs the full diametric width of cavity 110*g*. During flight of arrow A, the outward projection of forward levers 180*a* and 180*b* and rearward levers 190*a* and 190*b*, provides aerodynamic stabilization of broadhead 100 in flight. It is to be noted that the parabolic shape of tip portion 130 also assists in stabilizing broadhead 100 during flight.

As shown in FIG. 2, and as discussed above, a resilient band, such as a rubber band, cord, twine, string, or some other suitable material, is positioned between levers 180*a* and 180*b* and ledges 158 of forward blades 150*a*, 150*b*, respectively, and serves the purpose of retaining forward blades 150*a*, 150*b* and rearward blades 160*a*, 160*b* in the retracted position when broadhead 100 is not in use or when broadhead 100 is in flight. As noted above, once broadhead 100 hits a target T, the rearward force on levers 180*a* and 180*b*, and the consequential movement of forward blades 150*a* and 150*b*, causes band 240 to be severed, thereby allowing blades 150*a*,150*b*. 160*a* and 160*b* to deploy in the sequence described above.

Tip blades 170*a* and 170*b* could be constructed of 440C stainless steel, or any other suitable metal or ceramic, alloy, etc., and the frame 110 could be constructed of metals, alloys, plastics, ceramics, or other suitable materials or combinations of materials. The frame 110 could be anodized, but other suitable coatings could be used if desired, such a polytetrafluoroethylene (Teflon®), in order to reduce the coefficient of friction of the frame as it penetrates and passes into a target.

Turning to FIG. 5, tip blade 170*a* includes an elongated notch 174*a* for receipt of a notch 174*b* in tip blade 170*b* and a fastener 132 is inserted in a hole 110*a* in tip portion 130 and passes through a hole 176 in blade portion 170*a* to maintain tip blades 170*a* and 170*b* in place on tip portion 130. Fastener 132 could be a threaded fastener, screw, rivet, bolt, or some other fastener. Tip blade 170*a* includes a sharp cutting edge 172*a*, and tip blade 170*b* includes a sharp cutting edge 172*b*.

Referring to FIG. 7A, the engagement of blade stops 158*a* and 158*b* with post 118 prevents the reduction of the effective cutting diameter of forward blades 150*a*, 150, once deployed, from going below the minimum cutting diameter as shown in FIG. 7A. However, such blades may, in certain instances, form a larger effective cutting diameter, meaning the distance between the extreme outward end of each forward blade 150*a*, 150*b*. Similarly, as shown in FIG. 8A, while once deployed, the effective cutting diameter of rearward blades 160*a*, 160*b* is prevented from being less than the minimum cutting diameter shown in FIG. 8A, i.e., when blade stops 168*a*, 168*b* contact skirt 112. In other words, forward blades 150*a*, 150*b* are allowed to "float" upon deployment to a certain extent. In one implementation, the leading edge of forward blades 150*a*, 150*b*, are prevented by post 118 from being less than 45 degrees relative to longitudinal axis x, and the leading edge of rearward blades 160*a*, 160*b* are prevented by skirt 112 from being less than 30 degrees relative to longitudinal axis x.

In one implementation, the notched portions 164*a*, 164*b* of rearward blades 160*a*, 160*b*, respectively, each include a sharpened outboard edge 164*a*' and 164*b*', respectively, which facilitate movement of rearward blades 160*a*, 160*b* as such blades move from the retracted to the deployed position, bearing in mind that when such deployment occurs, such blades are being forced outwardly into the target, which may include being forced outwardly against internal tissue or organs of an animal, and the sharpened edges 164*a*' and 164*b*' facilitate cutting such tissue during the opening of blades 160*a*, 160*b* from the retracted towards the deployed positions. Similarly, ledges 158*a* and 158*b* of forward blades 150*a*, 150*b* are angled away from target T to facilitate in the opening of forward blades 150*a*, 150*b* within the target, which may include being forced outwardly against tissue of an animal.

As can be seen from the foregoing, implementations described herein provide a broadhead 100 which presents radially disposed cutting edges in four different planes, i.e., four different axis with respect to such blade orientation.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

What is claimed is:

1. A broadhead, comprising:

an elongated body;

a pivot pin fixedly engaging the elongated body;

a block fixedly engaging the elongated body;

a pair of forward blades pivotally connected to the elongated body, each forward blade configured to pivot outwardly from the elongated body upon ingress of the broadhead into a target, wherein:

when the pair of forward blades pivot outwardly about the pivot pin upon ingress of the broadhead into the target, the blades extend from the elongated body to a deployed position;

the pair of forward blades move rearward with respect to both the pivot pin and block upon ingress of the broadhead into the target; and the block acts as a blade lock to lock the pair of forward blades in the deployed position when the pair of forward blades pivot outwardly upon ingress of the broadhead into the target; and a pair of rearward blades pivotally connected to the elongated body, each rearward blade including a lever configured to cause the rearward blade to pivot outwardly from the elongated body when a predetermined force is applied to the lever;

wherein ingress of the broadhead into the target forms in the target a single elongated slit, and egress of the broadhead from the target forms in the target a first elongated slit and a second elongated slit bisecting the first elongated slit.

2. The broadhead of claim 1, wherein each forward blade and each rearward blade is configured to pivot relative to the elongated body between a retracted position generally adjacent to the elongated body and an extended position extending outwardly from the elongated body.

3. The broadhead of claim 2, wherein the forward blades are stacked with respect to one another and move through parallel planes during movement between the retracted position and the extended position.

4. The broadhead of claim 2, wherein the levers extend outwardly from the elongated body when rearward blades are in the retracted position.

5. The broadhead of claim 4, wherein the levers extend generally perpendicular to a longitudinal axis of the elongated body when the rearward blades are in the retracted position.

6. The broadhead of claim 4, wherein:

each lever is configured to cause the rearward blade from which the lever extends to pivot outwardly from the elongated body toward the extended position when the rearward blade is in the retracted position.

7. The broadhead of claim 1, wherein the forward blades are configured to move in opposite directions with respect to one another during movement between the retracted position and the extended position.

8. The broadhead of claim 1, wherein the rearward blades are configured to move in opposite directions with respect to one another during movement between the retracted position and the extended position.

9. The broadhead of claim 1, wherein the elongated body includes a rearward portion and a forward portion having a tip portion.

10. The broadhead of claim 9, wherein:

the rearward blades pivot away from the tip portion when a predetermined force is applied to the levers; and the forward blades pivot toward the tip portion upon ingress of the broadhead into a target.

11. A broadhead, comprising:

an elongated body including a forward portion having a tip, and a rearward portion spaced from the forward portion a pivot pin fixedly engaging the elongated body;

a block fixedly engaging the elongated body;

at least one forward blade pivotally connected to the forward portion of the body, the forward blade having a forward lever extending therefrom, wherein:

when the forward blade pivots outwardly about the pivot pin upon ingress of the broadhead into the target, the forward blade extends from the elongated body to a deployed position;

the forward blade moves rearward with respect to both the pivot pin and block upon ingress of the broadhead into the target; and the block acts as a blade lock to lock the forward blade in the deployed position when the forward blade pivots outwardly upon ingress of the broadhead into the target; and at least one rearward blade pivotally connected to the rear portion of the body, the rearward blade having a rearward lever extending therefrom;

wherein the at least one forward blade and the at least one rearward blade are independently movable between a respective retracted position adjacent the elongated body to an extended position extending outwardly from the elongated body.

12. The broadhead of claim 11, wherein:

the at least one forward blade includes a first forward blade and a second forward blade, each configured to move away from one another during movement between the retracted position and the extended position; and the at least one rearward blade includes a first rearward blade and a second rearward blade, each configured to move away from one another during movement between the retracted position and the extended position.

13. The broadhead of claim 12, wherein ingress of the broadhead into a target causes an entry opening in the target generally consisting of a single elongated slit, and egress of the broadhead from the target causes an exit opening generally consisting of a first elongated slit and a second elongated slit generally bisecting the first elongated slit.

14. The broadhead of claim 12, wherein the first and second blades are stacked with respect to one another and move through parallel planes during movement between the retracted position and the extended position.

15. The broadhead of claim 12, wherein:

the tip includes a first tip blade extending in a first plane and a second tip blade extending in a second plane angled with respect to the first plane;

the first forward blade moves between the retracted position and the extended position in a third plane;

the second forward blade moves between the retracted position and the extended position in a fourth plane substantially parallel to the third plane;

the first rearward blade and the second rearward blade each move between the retracted position and the extended position in a fifth plane;

the first plane is at an acute angle with respect to the third plane; and the fifth plane is generally perpendicular to both the third plane and the fourth plane.

* * * * *